US010239330B2

(12) United States Patent
Ohnishi et al.

(10) Patent No.: US 10,239,330 B2
(45) Date of Patent: Mar. 26, 2019

(54) INK JET RECORDING APPARATUS AND INK JET RECORDING METHOD

(71) Applicant: CANON KABUSHIKI KAISHA, Tokyo (JP)

(72) Inventors: Toru Ohnishi, Yokohama (JP); Kyosuke Deguchi, Yokohama (JP); Ryosuke Hirokawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/413,970

(22) Filed: Jan. 24, 2017

(65) Prior Publication Data

US 2017/0217216 A1 Aug. 3, 2017

(30) Foreign Application Priority Data

Jan. 29, 2016 (JP) ..... 2016-016674
May 30, 2016 (JP) ..... 2016-107969

(51) Int. Cl.
*B41J 2/21* (2006.01)
*B41J 11/00* (2006.01)
*B41J 2/005* (2006.01)

(52) U.S. Cl.
CPC ..... *B41J 11/0015* (2013.01); *B41J 2/0057* (2013.01); *B41J 2/2107* (2013.01); *B41J 2/2132* (2013.01)

(58) Field of Classification Search
CPC ..... B41J 2/0057; B41J 2/2107; B41J 2/2132; B41J 11/0015; G03G 15/10; G03G 15/16
See application file for complete search history.

(56) References Cited

U.S. PATENT DOCUMENTS

| | | | | |
|---|---|---|---|---|
| 4,920,361 | A | 4/1990 | Arahara et al. | |
| 7,370,948 | B2 | 5/2008 | Inoue | |
| 9,102,137 | B2 | 8/2015 | Koitabashi et al. | |
| 2006/0214958 | A1* | 9/2006 | Inoue | B41J 11/0015 347/5 |
| 2008/0055385 | A1* | 3/2008 | Houjou | B41M 5/0017 347/213 |
| 2016/0303847 | A1 | 10/2016 | Soma et al. | |

FOREIGN PATENT DOCUMENTS

| | | | |
|---|---|---|---|
| JP | 11-198359 | A | 7/1999 |
| JP | 2001-179959 | A | 7/2001 |
| JP | 2006-248173 | A | 9/2006 |
| JP | 2009-000915 | A | 1/2009 |
| JP | 2009-045851 | A | 3/2009 |
| JP | 2015-098097 | A | 5/2015 |

* cited by examiner

*Primary Examiner* — Kristal Feggins
*Assistant Examiner* — Kendrick Liu
(74) *Attorney, Agent, or Firm* — Venable LLP

(57) ABSTRACT

An ink jet recording apparatus includes an image forming unit configured to form an image containing a liquid and a coloring material on an ink receiving medium; a liquid absorbing member including a porous body that comes into contact with the image, the porous body being configured to absorb at least a part of the liquid from the image; and a plurality of pressure applying units configured to press the image on the ink receiving medium by the porous body. The plurality of pressure applying units include a first pressure applying unit configured to press the image at a first pressure and a second pressure applying unit configured to press the image having been pressed by the first pressure applying unit at a second pressure higher than the first pressure.

20 Claims, 7 Drawing Sheets

INK JET RECORDING APPARATUS AND INK JET RECORDING METHOD

BACKGROUND OF THE INVENTION

Field of the Invention

The present invention relates to an ink jet recording apparatus and an ink jet recording method.

Description of the Related Art

In an ink jet recording technique, an image is formed by applying a liquid composition (ink) including a coloring material directly or indirectly onto a recording medium. At this time, curling or cockling occurs because of excessive absorption of liquid components in the ink by the recording medium.

To prevent such a problem, there have been proposed techniques for quickly removing a liquid component in the ink, such as a technique of drying a recording medium with, for example, warm air or infrared rays, and a technique for forming an image on a transfer body, drying liquid components included in the image on the transfer body with, for example, thermal energy, and then transferring the image onto a recording medium such as paper.

Another proposed technique for removing liquid components included in an image on a transfer body is a technique of bringing a roller-shaped porous body into contact with an ink image to absorb and remove liquid components from the ink image without using thermal energy (see Japanese Patent Application Laid-Open No. 2009-045851).

Still another proposed technique is a technique of bringing a belt-shaped polymeric absorbent into contact with an ink image to absorb and remove liquid components from the ink image (see Japanese Patent Application Laid-Open No. 2001-179959).

Yet another proposed technique is a method of pressing a plurality of porous rollers against an intermediate transfer member under the same pressure in which the pore diameter or the aperture ratio of each porous roller is varied (Japanese Patent Application Laid-Open No. 2009-000915). This document mentions that as the pore diameter decreases, the capillary pressure increases, and the absorption amount is increased by reducing the pore diameter of a porous body that comes into contact with the image at the second time or later.

As described in this document, in a case where a roller- or belt-shaped liquid absorbing member is used for absorption and removal of a liquid component from an image, a nip in which the liquid absorbing member and an ink receiving medium contact each other is formed, and an image is caused to pass through the nip, thereby performing a liquid absorbing treatment.

In an image treatment in which a liquid component included in an image is absorbed by a porous body of a liquid absorbing member, a capillary pressure of the porous body plays an important role in intake of the liquid components into the porous body. In a state where an image contains a large content of liquid components and the content of the liquid components is large in an initial state of image fixation depending on image formation conditions, a polymeric absorbent as described in Japanese Patent Application Laid-Open No. 2001-179959 fails to obtain a sufficient effect of absorbing the liquid component in some cases.

In addition, in the case of using a porous body described in Japanese Patent Application Laid-Open No. 2009-045851 or Japanese Patent Application Laid-Open No. 2009-000915, in a state in which the content of the liquid components is large in an initial stage of image fixation, the liquid components in an image cannot be efficiently absorbed only by using a capillary pressure of the porous body in some cases. In particular, in a recording method in which a reaction liquid is caused to react to reduce bleeding and beading so that an aggregation including a coloring material is formed in an image, the image itself structurally has a capillary force, and an insufficient absorption amount is likely to be obtained only by using a simple capillary pressure of the porous body.

In such a case as described above, it is effective to use a pressure in pressing a porous body against an image together with a capillary pressure. In this case, it is necessary to increase a liquid component absorption amount, which is the amount of liquid components in an image absorbed by the porous body, to enhance a force of pressing the porous body against the image so that liquid components forced out of the image can be efficiently absorbed in the porous body.

In a state where the content of liquid components is large in an initial stage of image fixation, however, an image includes a coloring material insufficiently fixed onto an ink receiving medium. Thus, when a porous body is pressed against an image under a high pressure, the coloring material might adhere to the porous body. In addition, if an image deforms or is crushed under a high pressing force, an opportunity of contact between the coloring material in the image and the porous body increases, facilitating adhesion of the coloring material in some cases.

Accordingly, in the case of additionally using a pressing force in absorbing a liquid component included in an image by a porous body, there arises a technical objective of efficiently absorbing the liquid component while reducing adhesion of the coloring material. The patent documents described above, however, neither disclose nor suggest this technical objective.

The present invention has been made in view of the foregoing problems, and has an object of providing an image forming technique that enables image formation with high image quality by obtaining a large absorption amount with reduced adhesion of a coloring material with respect to a porous body in absorbing liquid components included in an image by the porous body to promote image fixation.

SUMMARY OF THE INVENTION

The present invention can provide an ink jet recording apparatus and an ink jet recording method that enable image formation with high image quality by obtaining a large absorption amount with reduced adhesion of a coloring material with respect to the porous body in absorbing liquid components by the porous body to promote image fixation.

In an aspect of the present invention, there is provided an ink jet recording apparatus including:

an image forming unit configured to form a first image containing a first liquid and a coloring material on an ink receiving medium;

a liquid absorbing member including a porous body that comes into contact with the first image, the porous body being configured to absorb at least a part of the first liquid from the first image; and a plurality of pressure applying units configured to press the first image on the ink receiving medium by the porous body of the liquid absorbing member, wherein the plurality of pressure applying units include a first pressure applying unit that presses the first image under a first pressure and a second pressure applying unit configured to press the first image having been pressed by the first pressure applying unit at a second pressure higher than the first pressure.

In another aspect of the present invention, there is provided an ink jet recording method including:

an image forming step of forming a first image containing a first liquid and a coloring material on an ink receiving medium; and a liquid absorbing step of bringing a porous body included in a liquid absorbing member into contact with the first image to cause the porous body to absorb at least a part of the first liquid from the first image, wherein the liquid absorbing step includes a plurality of pressure applying steps of pressing the first image on the ink receiving medium by the porous body of the liquid absorbing member, and wherein the plurality of pressure applying steps includes a first pressure applying step of applying a pressure at a first pressure and includes a pressure applying step of applying a second pressure higher than the first pressure after the first pressure applying step.

Further features of the present invention will become apparent from the following description of exemplary embodiments with reference to the attached drawings.

DESCRIPTION OF THE EMBODIMENTS

Figure 1:
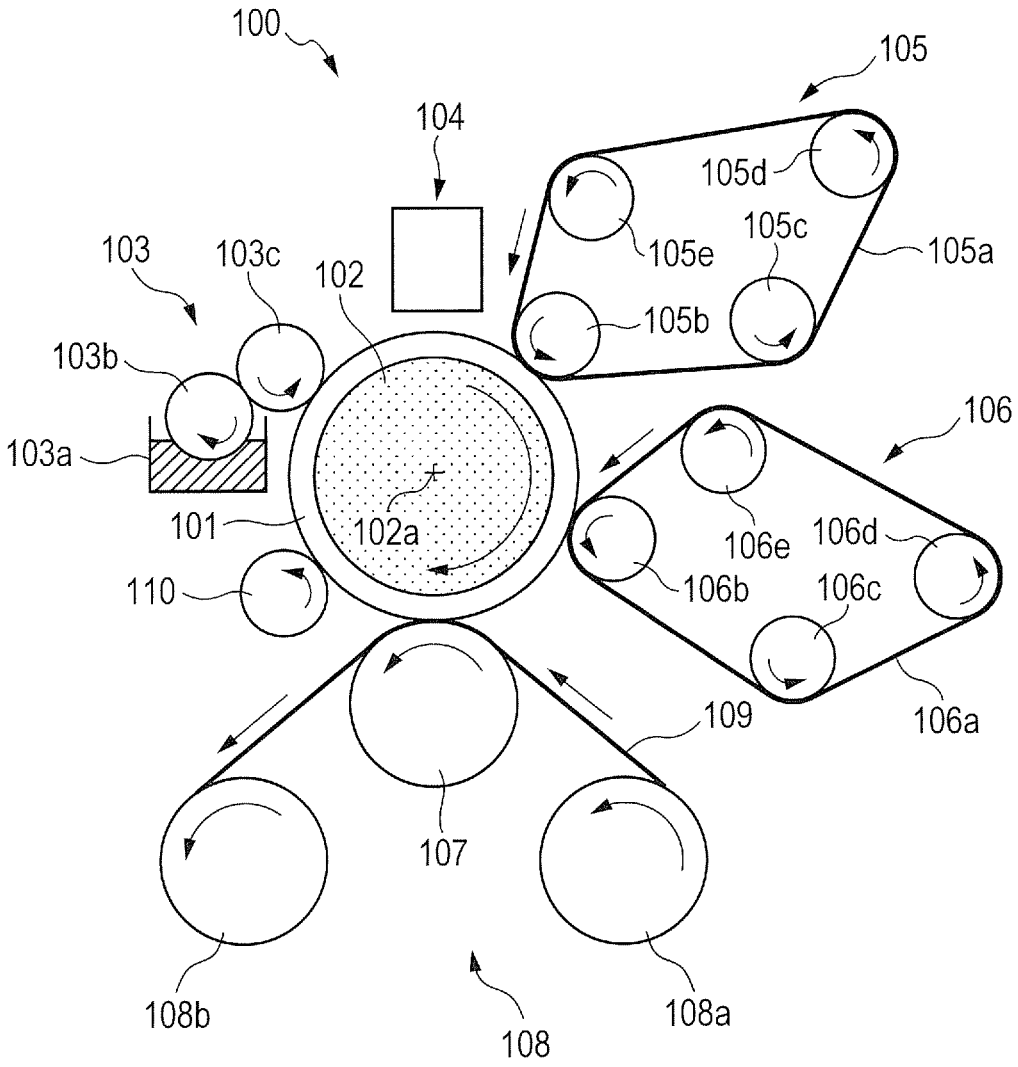
FIG. 1 schematically illustrates an example configuration of a transfer type ink jet recording apparatus according to the present invention.

Preferred embodiments of the present invention will now be described in detail in accordance with the accompanying drawings.

Inventors of the present invention made study to find that an absorption material of a metal porous body (a material obtained by sintering alumina particles) disclosed in Japanese Patent Application Laid-Open No. 2009-045851 is hydrophilic, shows high wettability with an aqueous ink and, thus, can facilitate adhesion of a coloring material to the absorption material depending on conditions of a liquid absorbing treatment. On the other hand, in the technique of Japanese Patent Application Laid-Open No. 2001-179959, a member having low affinity for a coloring material included in an ink is provided on a surface of a porous body, and thus adhesion of the coloring material to the porous body can be reduced. A member having a low affinity, however, has a low capillary pressure in many cases. Thus, to absorb liquid components sufficiently, a porous body needs to contact an image under a high pressure. When the porous body contacts the image under a high pressure, a coloring material can adhere to the porous body in some cases for the reasons described above.

In addition, in the case of using multi-stage porous rollers disclosed in Japanese Patent Application Laid-Open No. 2009-000915, a coloring material also easily adheres to the absorption member depending on conditions of a liquid absorbing treatment in some cases.

The inventors studied a technique for solving the technical issue of performing an effective liquid absorbing treatment while reducing adhesion of a coloring material from an image to a porous body. Consequently, the inventors found that the technical issue can be achieved by using a multi-stage pressing process in which the progress of fixation of an image containing liquid components is utilized, in particular, different pressing forces are used by utilizing the relationship between the content of a liquid component in an image and a pressing force of a porous body. The present invention has been achieved based on new findings of the inventors.

Embodiments of an ink jet recording method and an ink jet recording apparatus according to the present invention will be described hereinafter.

An ink jet recording method according to the present invention includes an image forming step of forming a first image containing a first liquid and a coloring material on an ink receiving medium; and a liquid absorbing step of bringing a porous body of a liquid absorbing member into contact with the first image so that the porous body absorbs at least a part of a liquid component including the first liquid from the first image.

The first image is an image as a target of a liquid absorbing treatment constituted by an ink image containing the liquid component including the first liquid and the coloring material. In other words, the first image is an ink image before liquid removal that is yet to be subjected to the liquid absorbing treatment. In the liquid absorbing step, a nip part is formed by a contact surface of the porous body of the liquid absorbing member that comes into contact with the first image, that is, the first surface, and a surface of the ink receiving medium on which the first image is to be formed and which faces the first surface of the porous body. The first image is caused to pass through the nip part in such a manner that the first image contacts with the first surface of the porous body so that at least a part of the liquid component is removed from the first image to the porous body, thereby obtaining a second image in which the liquid component is reduced. The second image is an ink image after liquid removal which has been subjected to the liquid absorbing treatment so that the content of a first liquid (aqueous liquid component) is reduced.

The absorption of the liquid component from the first image in the nip part can be more effectively performed by applying a pressure for pressing the porous body of the liquid absorbing member against the ink receiving medium. This pressure application can be performed by pressing from the ink receiving medium and/or the liquid absorbing member. The pressing against the nip part may use a known pressing unit. The nip part capable of pressing can constitute a pressure applying unit.

In the present invention, the liquid absorbing step includes a multistage pressure applying step of bringing the porous body of the liquid absorbing member into contact with the first image by applying a pressure at least twice.

This multistage pressure applying step may include the following combinations of steps performed on the same first image.

(A) A pressing step (P-1) in a pressure applying unit (P-1) to form the nip part with a pressing force (P-1).

(B) A pressing step (P-2) which is performed after the pressing step (P-1) and in which the pressing step (P-2) in a pressure applying unit (P-2) to form a nip part with a pressing force (P-2) is performed under the condition P1<P2.

At least a combination of the pressing steps performed with different pressing forces may be introduced into the multistage pressing step.

For example, in the case of using two pressing steps, the two pressing steps are the pressing step (P-1) and the pressing step (P-2).

On the other hand, in the case of using three pressing steps (A) to (C), combinations of pressing forces as described below may be used.

TABLE 1

| Pressure applying step | Combination 1 | Combination 2 |
|---|---|---|
| A | P1-1 | P1 |
| B | P1-2 | P2-1 |
| C | P2 | P2-2 |

In combination 1, P1-1 or P1-2<P2, while in combination 2, P1<P2-1 or P2-2. The relationship between P1-1 and P1-2 and the relationship between P2-1 and P2-2 may be arbitrarily set depending on purposes, and P1-1<P1-2 and P2-1<P2-2 are preferable. In the case of using the pressing step in four or more stages, each stage is assigned to the pressing step (P-1) or the pressing step (P-2) so that at least one of the combinations of the pressing steps satisfying P1<P2 is included in the liquid absorbing step.

Each of the pressing steps can independently select the type and liquid absorbing performance of the porous body which is a constituent of the liquid absorbing member. For example, the liquid absorbing member used in the pressure applying steps can include one or combinations of liquid absorbing members. In addition, the same porous body may be used as porous bodies used in the pressing steps, or different porous bodies may be used in the pressing steps. In the case of using the same porous body in the pressing steps, a common liquid absorbing member can be used in the pressing steps.

In the case of using different porous bodies in the pressing steps, an average pore diameter of a porous body used in the pressure applying step (P-2) is preferably larger than an average pore diameter of a porous body used in the pressure applying step (P-1). In addition, the average pore diameter of the porous body used in the pressure applying step (P-1) is preferably 0.1 μm or less, and the average pore diameter of the porous body used in the pressure applying step (P-2) is preferably 1 μm or more.

The Gurley value G2 of the porous body used in the pressure applying step (P-2) is preferably larger than the Gurley value G1 of the porous body used in the pressure applying step (P-1).

In the present invention, P1 and P2 only need to be set in such a manner that coloring material adhesion is reduced and liquid is absorbed, and P1 and P2 are not specifically limited. In consideration of, for example, an apparatus configuration and a wet state of a first image, the pressure P1 is preferably selected to be 14.71 N/cm$^2$ (1.5 kgf/cm$^2$) or less. Similarly, the pressure P2 is preferably lower than the yield stress of a dried product of the image. The yield stress can be measured with a known rheometer.

The difference between P1 and P2 (P2>P1) is preferably set in the range from 16.61 to 98.07 N/cm$^2$ (2 to 10 kgf/cm$^2$).

As described above, in the pressing steps, for the condition in setting P1 and P2 so that the pressure applying step (P-2) satisfies P1<P2 in the pressure applying step (P-1), when a pressing member in a pressing step has a roller shape, a roller radius, an elasticity, and a load thereof are adjusted to satisfy P1<P2. In particular, when the roller radius R1 of the pressing member in the pressure applying step (P-1) and the roller radius R2 of the pressing member in the pressure applying step (P-2) satisfy R1>R2, the absorption amount is large.

An ink jet recording apparatus applicable to an ink jet recording method according to the present invention includes an image forming unit configured to form a first image containing a first liquid and a coloring material at least on an ink receiving medium, and a liquid absorbing member including a porous body having a first surface that comes into contact with the first image, wherein the porous body is configured to absorb at least a part of the first liquid from the first image.

As described above, removal of the liquid component from the first image by the liquid absorbing member is performed in the pressing part including the ink receiving medium, the porous body of the liquid absorbing member and the pressing device. The liquid component can be absorbed from the first image by causing the first image on the ink receiving medium to pass through the pressed nip part. This nip part can be constituted by a nip part forming unit configured to form the nip part by bringing the first surface of the porous body of the liquid absorbing member into contact with a surface of the ink receiving medium facing the first surface.

The image forming unit is not specifically limited as long as the first image containing the first liquid and the coloring material can be formed on the ink receiving medium. Preferably, the image forming unit includes (1) a first applying unit configured to apply a first liquid composition including a first liquid or a second liquid onto an ink receiving medium, and (2) a second applying unit configured to apply a second liquid composition including either the first liquid or the second liquid and the coloring material onto the ink receiving medium.

At least one of the first liquid composition or the second liquid composition includes the first liquid.

The first image as a target of a liquid absorbing treatment is formed by applying the first liquid composition and the second liquid composition onto the ink receiving medium so that the first and second liquid compositions have at least overlapping regions. The first liquid composition increases fixation of the coloring material applied onto the ink receiving medium together with the second liquid composition. This increase of fixation of the coloring material refers to such a phenomenon that the fluidity of an ink itself or a coloring member in the ink decreases by an action of the first liquid composition to result in a state in which the second liquid composition does not easily flow from an initial state in which the second liquid composition applied onto the ink receiving medium has fluidity. This mechanism will be described later.

The first image includes a mixture of the first liquid composition and the second liquid composition. The second liquid composition is an ink including a liquid medium and a coloring material, and the device that applies the second liquid composition onto the ink receiving medium is an ink jet recording device. The first liquid composition can include a component that chemically or physically acts on the second liquid composition so that the mixture of the first and second liquid compositions is viscously thickened more than each of the first and second liquid compositions to increase fixation of the coloring material. The first liquid composition can include an aqueous liquid medium. The aqueous liquid medium includes at least water and may include an aqueous organic solvent and various additives as necessary.

In a case where water is the first liquid, at least one of the first liquid composition and the second liquid composition can include a second liquid that is a liquid except the first liquid. The second liquid may have any volatility but preferably has a volatility higher than that of the first liquid.

As the first liquid, a liquid that serves as a main cause of a decrease in a fixation rate, beading of an image and the like when being at least partially included in the first image is selected. In a case where an aqueous pigment ink is used as the second liquid composition or a reaction liquid including an aqueous medium is used as the first liquid composition, water is preferably selected as the first liquid.

An embodiment of the present invention will now be described. In the following embodiment, a reaction liquid is used as the first liquid composition, and a reaction liquid applying device is used as a liquid applying unit configured to apply a first liquid composition onto an ink receiving medium. An ink is used as a second liquid composition, and an ink applying device is used as a liquid applying unit configured to apply a second liquid composition onto the ink receiving medium.

Reaction Liquid Applying Device

The reaction liquid applying device may be any device that can apply a reaction liquid onto an ink receiving medium, and various known devices may be used as appropriate. Specifically, examples of the reaction liquid applying device include a gravure offset roller, an ink jet head, a die coating device (die coater), and a blade coating device (blade coater). The application of the reaction liquid by the reaction liquid applying device may be performed before application of an ink or after application of the ink as long as the reaction liquid can be mixed (react) with the ink on an ink receiving medium. Preferably, the reaction liquid is applied before application of the ink. The application of the reaction liquid before application of the ink can suppress bleeding in which adjacently applied inks are mixed and beading in which a previously impacting ink is attracted to a subsequently impacting ink, in image recording by an ink jet technique.

Reaction Liquid

The reaction liquid includes a component that increases the viscosity of ink (ink-viscosity-increasing component). The increase of ink viscosity here refers to a phenomenon that components constituting the ink, such as a coloring material and a resin, come into contact with the ink-viscosity-increasing component to cause a chemical reaction therewith or physical adsorption thereonto, so that an increase of the viscosity of the ink is observed. This increase of the ink viscosity includes not only a case where an increase of the ink viscosity is observed but also a case where the viscosity locally increases because of aggregation of a part of components constituting the ink such as a coloring material and a resin. As a method for agglomerating a part of a component constituting the ink, a reaction liquid that reduces a dispersion stability of a pigment in an aqueous ink can be used. The ink-viscosity-increasing component has an effect of reducing fluidity of the ink and/or some of components constituting the ink on an ink receiving medium to suppress bleeding and beading in forming a first image. The increase of the ink viscosity will also be hereinafter referred to as "viscously thickening the ink." As such an ink-viscosity-increasing component, known materials such as polyvalent metal ions, organic acids, cationic polymers, and porous fine particles may be used. In particular, polyvalent metal ions and organic acids are preferably used. A plurality of types of ink-viscosity-increasing components may be preferably included. The content of the ink-viscosity-increasing component in the reaction liquid is preferably 5 mass % or more of the total mass of the reaction liquid.

Examples of the polyvalent metal ions include divalent metal ions such as $Ca^{2+}$, $Cu^{2+}$, $Ni^{2+}$, $Mg^{2+}$, $Sr^{2+}$, $Ba^{2+}$, and $Zn^{2+}$ and trivalent metal ions such as $Fe^{3+}$, $Cr^{3+}$, $Y^{3+}$, and $Al^{3+}$.

Examples of the organic acids include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumalic acid, thiophene carboxylic acid, nicotinic acid, oxysuccinic acid, and dioxysuccinic acid.

The reaction liquid may include appropriate amounts of water, a mixture of water and an aqueous organic solvent and/or a low-volatile organic solvent, as the first liquid. Water used in this case is preferably water deionized by, for example, ion exchange. The organic solvent that can be used for the reaction liquid applicable to the present invention is not specifically limited, and any known organic solvent may be used.

In using the reaction liquid, the surface tension and the viscosity of the reaction liquid are adjusted as necessary by adding a surfactant and a viscosity modifier. Any material that can coexist with the ink-viscosity-increasing component may be used. Specific examples of the surfactant include an acetylene glycol ethylene oxide adduct (trade name: "Acetylenol E100" manufactured by Kawaken Fine Chemicals Co., Ltd.) and a perfluoroalkyl ethylene oxide adduct (trade name: "Megafac F444" manufactured by DIC Corporation).

Ink Applying Device

As an ink applying device that constitutes an ink jet recording unit and applies an ink, an ink jet head that discharges a liquid by an ink jet method is used. The ink jet head may be of a type that discharges an ink by causing film boiling in the ink by an electrothermal converter and, thereby, forms bubbles, a type that discharges an ink with an electromechanical converter, or a type that discharges an ink by using static electricity. In the present invention, a known ink jet head may be used. In particular, from the viewpoint of printing at high speed with high density, the type that uses an electrothermal converter is preferably used. In image formation, an image signal is received, and an ink in an amount necessary for each location is applied.

The amount of ink application can be expressed as an image density (duty) or an ink thickness, and in the present invention, the amount of ink application ($g/m^2$) is expressed as an average value obtained by multiplying the mass of each ink dot by the number of applied dots (the number of discharges) followed by being divided by a printed area. The maximum amount of ink applied on an image region refers to an amount of ink applied on at least an area of 5 $mm^2$ or more in a region used as information of an ink receiving medium, from the viewpoint of removing liquid components of the ink.

An ink jet recording apparatus according to the present invention may include a plurality of ink jet heads in order to apply inks of colors on an ink receiving medium. In the case of forming color images using a yellow ink, a magenta ink, a cyan ink, and a black ink, the ink jet recording apparatus includes four ink jet heads that respectively discharge the four types of inks onto the ink receiving medium.

The ink applying member may include an ink jet head that discharges an ink including no coloring materials (clear ink).

Ink

Components of an ink applied to the present invention will be described.

Coloring Material

As a coloring material included in the ink applied to the present invention, a pigment or a mixture of a pigment and a dye may be used. The pigment that can be used as a coloring material is not specifically limited. Specific examples of the pigment include inorganic pigments such as carbon black; and organic pigments such as an azo-based pigment, a phthalocyanine-based pigment, a quinacridone-based pigment, an isoindolinone-based pigment, an imidazolone-based pigment, a diketo-pyrrolo-pyrrole-based pigment, and a dioxazine-based pigment. These pigments may be used singly or two or more of the pigments may be used in combination.

The dye that can be used as a coloring material is not specifically limited. Specific examples of the dye include a direct dye, an acid dye, a basic dye, a disperse dye, and a food dye, and a die having an anionic group may also be used. Specific examples of a dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5 mass % or more to 15.0 mass % or less and more preferably 1.0 mass % or more to 10.0 mass % or less of the total mass of the ink.

Dispersant

As a dispersant for dispersing a pigment, a known dispersant for an ink jet ink may be used. In particular, in an aspect of the present invention, a water-soluble dispersant having a hydrophilic part and a hydrophobic part in its structure is preferably used. In particular, a pigment dispersant formed of a copolymerized resin including at least a hydrophilic monomer and a hydrophobic monomer is preferably used. The monomers used here are not limited to specific types, and known monomers are preferably used. Specific examples of the hydrophobic monomer include styrene and other styrene derivatives, alkyl(meth)acrylate, and benzyl(meth)acrylate. Examples of the hydrophilic monomer include acrylic acid, methacrylic acid, and maleic acid.

The dispersant preferably has an acid value of 50 mgKOH/g or more to 550 mgKOH/g or less. The dispersant preferably has a weight-average molecular weight of 1000 or more to 50000 or less. The mass ratio of the pigment to the dispersant (pigment:dispersant) is preferably in the range from 1:0.1 to 1:3.

It is also preferable in the present invention to replace the dispersant with a so-called self-dispersible pigment in which the surface of the pigment itself is modified so that the pigment can be dispersed.

Resin Fine Particles

The ink applied to the present invention can be used while containing various types of fine particles including no coloring materials. In particular, resin fine particles are preferably used because the resin fine particles can effectively enhance image quality and fixability.

The material of the resin fine particles applicable to the present invention is not specifically limited, and any known resin may be used as appropriate. Specific examples of such a resin include monopolymers such as polyolefin, polystyrene, polyurethane, polyester, polyether, polyurea, polyamide, polyvinyl alcohol, poly(meth)acrylic acid and a salt thereof, poly(meth)acrylic acid alkyl, and polydiene, and copolymers obtainable by polymerizing a plurality of types of monomers for producing these monopolymers.

The resin preferably has a weight-average molecular weight (Mw) of 1,000 or more to 2,000,000 or less. The amount of resin fine particles in the ink is preferably 1 mass % or more to 50 mass % or less and more preferably 2 mass % or more to 40 mass % or less of the total mass of the ink.

In an aspect of the present invention, the resin fine particles are preferably used as a resin fine particle dispersion in which the resin fine particles are dispersed in a liquid. The dispersion technique is not specifically limited, and a so-called self-dispersing type resin fine particle dispersion in which particles are dispersed by using a resin obtained by homopolymerizing or copolymerizing one or more types of monomers having a dissociable group is preferably employed. Examples of the dissociable group include a carboxyl group, a sulfonic acid, and a phosphoric acid. Examples of the monomer having such a dissociable group include acrylic acid and methacrylic acid. Similarly, a so-called emulsion-dispersion type resin fine particle dispersion in which resin fine particles are dispersed by an emulsifier is also preferably used in the present invention. The emulsifier here is preferably a known surfactant, irrespective of whether the molecular weight of the surfactant is low or high. The surfactant is preferably a nonionic surfactant or a surfactant having the same charge as that of resin fine particles.

The resin fine particle dispersion used in an aspect of the present invention preferably has a dispersed particle size of 10 nm or more to 1000 nm or less, and more preferably has a dispersed particle size of 50 nm or more to 500 nm or less.

In producing the resin fine particle dispersion for use in an aspect of the present invention, various types of additives are preferably added for stability. Examples of the additives include n-hexadecane, dodecyl methacrylate, stearyl methacrylate, chlorobenzene, dodecylmercaptan, a blue dye (bluing agent), and polymethyl methacrylate.

Surfactant

Ink that can be used in the present invention may include a surfactant. Specific examples of the surfactant include an acetylene glycol ethylene oxide adduct (Acetylenol E100, manufactured by Kawaken Fine Chemicals Co., Ltd.). The amount of the surfactant in the ink is preferably 0.01 mass % or more to 5.0 mass % or less of the total mass of the ink.

Water and Water-Soluble Organic Solvent

Ink used in the present invention may include water and an aqueous liquid medium such as a mixture of water and a water-soluble organic solvent. Water used in this case is preferably water deionized by, for example, ion exchange. The content of water in the ink is preferably 30 mass % or more to 97 mass % or less and more preferably 50 mass % or more to 95 mass % or less of the total mass of the ink.

As an aqueous ink that can include at least water as a liquid medium, an aqueous pigment ink including at least a pigment as a coloring material can be used. The water-soluble organic solvent used in the present invention is not specifically limited, and any known organic solvent may be used. Specific examples of the organic solvent include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Two or more of these organic solvents may be used in combination, of course.

The content of the water-soluble organic solvent in the ink is preferably 3 mass % or more to 70 mass % or less of the total mass of the ink.

Other Additives

An ink that can be used in the present invention may include various additives as necessary, such as a pH adjuster, a rust preventive, an antiseptic agent, a mildew proofing agent, an oxidation inhibitor, an antireduction agent, a water-soluble resin, a neutralizer for a water-soluble resin, and a viscosity modifier, in addition to the components described above.

Liquid Absorbing Member

In this embodiment, at least a part of the first liquid is brought into contact with a liquid absorbing member including a porous body to be absorbed from a first image so that the content of a liquid component in the first image is reduced. The surface of the liquid absorbing member that is brought into contact with the first image is a first surface on which the porous body is disposed.

Porous Body

The porous body of the liquid absorbing member can be appropriately selected from a porous body the whole of which has a uniform pore diameter distribution and a porous body in which an average pore diameter in the first surface is smaller than an average pore diameter in the second surface opposite to the first surface.

The average pore diameter refers to an average diameter in the first surface or the second surface, and can be measured by a known method such as a mercury intrusion porosimetry, a nitrogen adsorption method, or an SEM image analysis.

The Case of Using Same Porous Body in Pressing Steps

In the case of using the same porous body in pressing steps, a porous body the whole of which has a uniform pore diameter distribution or a porous body in which an average pore diameter in the first surface is smaller than an average pore diameter in the second surface opposite to the first surface can be used. The term "same porous body" includes a case where the same material is used in different units. The use of the same material is preferable because costs can be reduced. In addition, the following porous bodies are preferably selectively used.

The porous body in this case is preferably a porous body in which the average pore diameter in the first surface is smaller than the average pore diameter in the second surface opposite to the first surface. To reduce adhesion of a coloring material in an ink to the porous body, the pore diameter is preferably as small as possible, and at least the average pore diameter of the porous body in the first surface that comes into contact with an image is preferably 10 μm or less, and more preferably 0.2 μm or less. On the other hand, to enhance absorption of liquid components in the porous body, at least the average pore diameter of the porous body in the first surface that comes into contact with the image is preferably 0.05 μm or more, and more preferably 0.1 μm or more.

To obtain a uniformly high air permeability, the porous body is preferably thin. The air permeability can be represented by a Gurley value defined in JIS P8117, and the Gurley value is preferably 10 seconds or less.

It should be noted that an excessively thin porous body might fail to obtain a capacity sufficient for absorbing liquid components, and thus the porous body can have a multilayer structure. In the liquid absorbing member, only a layer that comes into contact with a first image needs to be a porous body, and a layer that does not contact the first image does not need to be a porous body.

Multilayer Structure

An embodiment in a case where a porous body has a multilayer structure will now be described. In the following description, a layer that comes into contact with a first image is a first layer, and a layer that is laminated on a surface opposite to the surface that comes into contact with the first image is a second layer. Layers constituting the multilayer structure will be sequentially described from the first layer in the order of lamination. In this specification, the first layer will be also referred to as "absorption layer" and a layer including the second and subsequent layers will also be referred to as "support layer."

First Layer

In the present invention, the material of the first layer is not limited to a specific material, and any of a hydrophilic material having a contact angle with water of less than 90° or a water-repellent material having a contact angle with water of 90° or more may be used. In the case of a hydrophilic material, the contact angle with water is preferably 40° or less. In a case where the first layer is made of a hydrophilic material, an aqueous liquid component can be sucked by a capillary force.

Examples of the hydrophilic material include polyolefin (e.g., polyethylene (PE), polypropylene (PP)), polyurethane, nylon, polyamide, polyester (e.g., polyethylene terephthalate (PET)), and polysulfone (PSF).

On the other hand, to reduce coloring material adhesion or enhance cleanability, the material of the first layer is preferably a water-repellent material having a low surface free energy, particularly, a fluororesin. Specific examples of the fluororesin include polytetrafluoroethylene (hereinafter referred to as PTFE), polychlorotrifluoroethylene (PCTFE), polyvinylidene fluoride (PVDF), polyvinyl fluoride (PVF), perfluoro-alkoxyfluoro resin (PFA), tetrafluoroethylene-hexafluoropropylene copolymer (FEP), ethylene-tetrafluoroethylene copolymer (ETFE), and ethylene-chlorotrifluoroethylene copolymer (ECTFE). One or more of these resins may be used as necessary, and a plurality of films are laminated in the first layer.

In the case where the first layer is made of a water-repellent material, aqueous liquid components are hardly sucked by a capillary force, and consequently it can take a long time to absorb aqueous liquid components when the layer first contacts with an image. Thus, the first layer is preferably impregnated with a liquid having a contact angle with the first layer of less than 90°. In addition to the first liquid in a first image and an optional second liquid, a liquid used for impregnating the first layer will be also referred to as a third liquid (wetting liquid). The third liquid can be applied onto the first surface of the liquid absorbing member so that the first layer is impregnated with the third liquid. The third liquid is preferably prepared by mixing the first liquid (water) with a surfactant or a liquid having a small contact angle with respect to the first layer. The third liquid is gradually replaced with the first liquid, and thus the absorption efficiency of the first layer gradually decreases.

Thus, the third liquid is preferably applied onto the first surface of the liquid absorbing member at every predetermined number of times with an application device for the third liquid.

In the present invention, the thickness of the first layer is preferably 50 μm or less. The thickness is more preferably 30 μm or less. In examples of the present invention, the thickness was measured at ten arbitrary points with a non-rotating spindle type micrometer OMV_25 (manufactured by Mitutoyo Corporation) and calculating an average value.

The first layer can be produced by a known method for producing a thin porous film. For example, the thin porous film can be obtained by obtaining a sheet of a resin material with, for example, extrusion molding and then drawing the sheet to a predetermined thickness. A porous film can also be obtained by adding a plasticizer such as paraffin to a material for extrusion molding and removing the plasticizer by, for example, heating during drawing. The pore diameter can be adjusted by appropriately adjusting the addition amount of the plasticizer or the draw ratio, for example.

Second Layer

In the present invention, the second layer is preferably an air-permeable layer. Such a layer may be a nonwoven fabric of resin fibers or a woven fabric. The material of the second layer is not limited to a specific material, and is preferably a material having a contact angle with a first liquid that is substantially equal to or less than the contact angle with a first liquid of the first layer so that a liquid absorbed in the first layer does not flow back. Specific examples of the material include polyolefin (e.g., polyethylene (PE), polypropylene (PP)), polyurethane, nylon, polyamide, polyester (e.g., polyethylene terephthalate (PET)), a single material such as polysulfone (PSF), and a composite material of at least two of these materials. The second layer preferably has a pore diameter larger than that of the first layer.

Third Layer

In the present invention, a porous body having a multilayer structure may include three or more layers. The third layer (also referred to as a third layer) and subsequent layers are preferably nonwoven fabrics, from the viewpoint of rigidity. A material similar to those for the second layer is used.

Other Materials

In addition to the porous body having the lamination structure described above, the liquid absorbing member may include a reinforcing member for reinforcing a side surface of the liquid absorbing member. The liquid absorbing member may include a joint member that joins longitudinal ends of a long sheet-shaped porous body together to form a belt-shaped member. As such a material, a non-porous tape material, for example, may be used, and may be disposed at a position or in a cycle at which the material does not contact with an image.

The Case of Using Different Porous Bodies in Pressing Steps

In the case of using different porous bodies in a plurality of pressing steps, a porous body the whole of which has a uniform pore diameter distribution and a porous body in which an average pore diameter in the first surface is smaller than an average pore diameter in the second surface opposite to the first surface (including a porous body having a multilayer structure) may be used. In addition, the following porous bodies are preferably selectively used.

A pore diameter D1 in a region including at least the surface of a porous body used in the pressing step P1 which comes into contact with an image is preferably set smaller than a pore diameter D2 of a region including at least the surface of a porous body used in the pressing step P2 which comes into contact with an image (i.e., D1<D2). Such a pore diameter difference enables liquid absorption while reducing coloring material adhesion in the pressing step P1 and further reduction of durability in the pressing step P2. The pore diameters D1 and D2 of the porous bodies to obtain the above advantages can be selected from the pore diameter range described above (in the case of using the same porous body in pressing steps).

The difference between D1 and D2 (D2−D1) can be set to obtain intended advantages of the present invention, and is preferably selected from the range of 0.3 μm<(D2−D1)<3.5 μm.

Porous bodies having different Gurley values may be used in a plurality of pressing steps. In this case, the Gurley value G2 of the porous body in the pressure applying step (P-2) is preferably smaller than the Gurley value G1 of the porous body in the pressure applying step (P-1) (i.e., G1>G2). The use of such a difference between Gurley values can also obtain sufficient durability in the pressing step P2.

Both the G1 and G2 can be selected from the range described above (in the case of using the same porous body in pressing steps).

The difference between G1 and G2 (G1−G2) can be set to obtain intended advantages of the present invention, and is preferably selected from the range of one second<(G1−G2)<10 seconds.

Method for Producing Porous Body

The method for forming a porous body by laminating a first layer and a second layer is not specifically limited. The layers may be simply overlaid with each other or may be bonded together by lamination with an adhesive agent or lamination with heating. From the viewpoint of air permeability, the lamination with heating is preferable in the present invention. For example, the first layer and the second layer may be partially melted to be laminated and bonded together by heating. Alternatively, a welding material such as a hot-melt powder may be interposed between the first layer and the second layer to bond and laminate the first and second layers by heating. In the case of laminating the third and subsequent layers, these layers may be laminated at a time, or may be sequentially laminated. The order of the lamination may be selected as appropriate.

In the heating process, a lamination method of heating a porous body while pressing the porous body with heated rollers is preferable.

A specific embodiment of an ink jet recording apparatus according to the present invention will now be described.

Examples of an ink jet recording apparatus according to the present invention include an ink jet recording apparatus that forms a first image on a transfer body as an ink receiving medium and transfers, onto the recording medium, a second image after a liquid absorbing member has absorbed the first liquid (aqueous liquid component), and an ink jet recording apparatus that forms a first image on a recording medium as an ink receiving medium. In the present invention, the former ink jet recording apparatus will be hereinafter referred to as a transfer type ink jet recording apparatus for convenience of description, and the latter ink jet recording apparatus will be hereinafter referred to as a direct drawing type ink jet recording apparatus for convenience of description.

The ink jet recording apparatuses will now be described.

Transfer type Ink Jet Recording Apparatus

Figure 2:
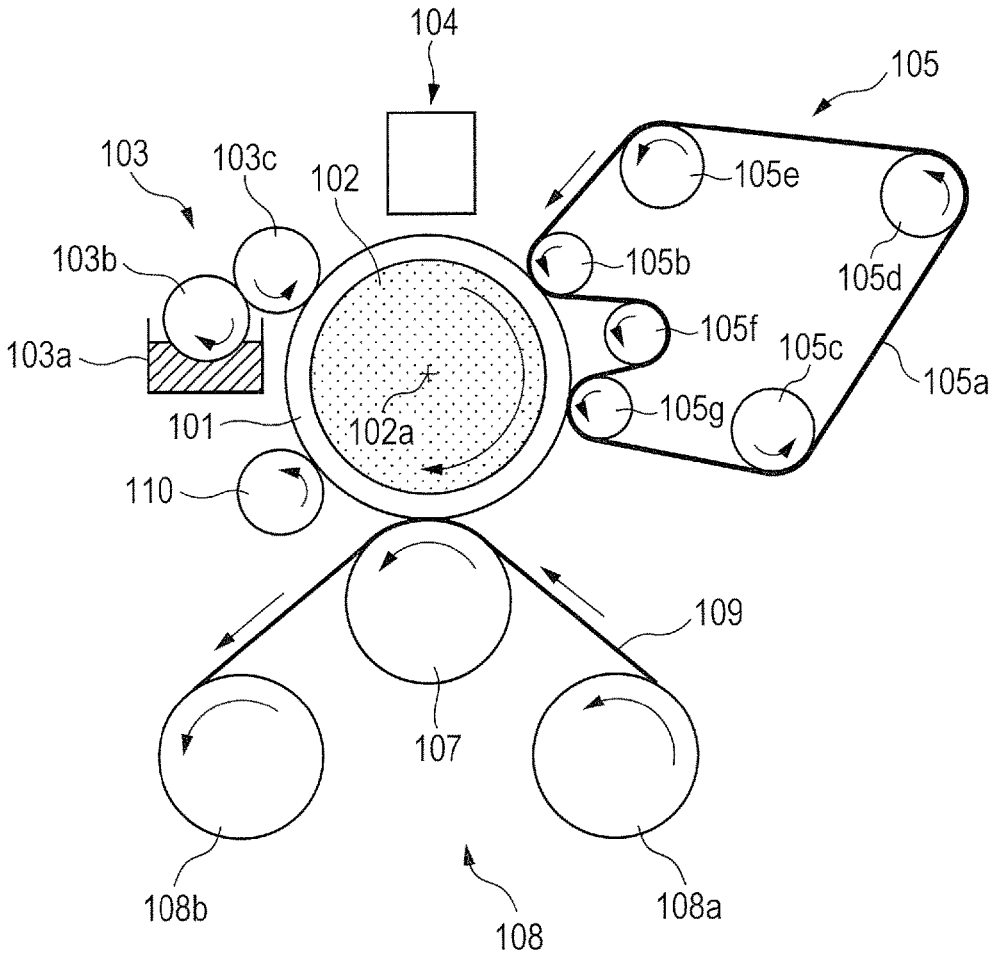
FIG. 2 schematically illustrates an example configuration of a transfer type ink jet recording apparatus according to the present invention.

FIGS. 1 and 2 schematically illustrate an example configuration of a transfer type ink jet recording apparatus according to an embodiment of the invention.

A transfer type ink jet recording apparatus 100 includes a transfer body 101 to temporarily hold a first image and a second image in which at least a part of the aqueous liquid component is absorbed and removed from the first image. The transfer type ink jet recording apparatus 100 also includes a transfer unit including a pressing member 106 for transfer (hereinafter referred to as a transfer pressing member) to transfer the second image onto a recording medium 109 on which an image is to be formed, that is, a recording medium to form a final image in accordance with an intended application.

The transfer type ink jet recording apparatus illustrated in FIG. 1 includes two liquid absorbing devices 105 and 106 each including a pressure applying unit. The transfer type ink jet recording apparatus illustrated in FIG. 2 includes one liquid absorbing device 105 and two pressing members 105*b* and 105*g* for liquid removal each constituting a pressure applying unit.

In the illustrated apparatus, the nip part forming unit constituting the pressure applying unit includes a transfer body and a pressing member for liquid removal. Each pressing member is connected to a pressing device (not shown) so that the pressing member can apply a desired pressure to the transfer body.

As illustrated in in FIGS. 1 and 2, the transfer type ink jet recording apparatus 100 according to the present invention includes the transfer body 101 supported by a support member 102; a reaction liquid applying device 103 configured to apply a reaction liquid onto the transfer body 101; an ink applying device 104 configured to apply an ink onto the transfer body 101 provided with the reaction liquid to form an ink image on the transfer body 101; liquid absorbing devices 105 and 106 configured to absorb a liquid component from the first image on the transfer body 101; and the transfer pressing member 107 configured to transfer the second image on the transfer body 101 from which the liquid component has been removed onto the recording medium 109 such as paper by pressing the recording medium. The transfer type ink jet recording apparatus 100 may further include a transfer body cleaning member 110 to clean a surface on the transfer body 101 onto which the second image has been transferred onto the recording medium 109, as necessary.

A support member 102 rotates about a rotation axis 102*a* in a direction indicated by an arrow A in FIGS. 1 and 2. The rotation of the support member 102 causes the transfer body 101 to move. Onto the moving transfer body 101, the reaction liquid and the ink are sequentially applied by the reaction liquid applying device 103 and the ink applying device 104, respectively, thereby forming a first image on the transfer body 101. The movement of the transfer body 101 causes the first image formed on the transfer body 101 to move to a location at which the first image contacts with a liquid absorbing members 105*a* and 106*a* of the liquid absorbing devices 105 and 106.

The liquid absorbing members 105*a* and 106*a* of the liquid absorbing devices 105 and 106 rotate in synchronization with rotation of the transfer body 101. The first image formed on the transfer body 101 comes into contact with the moving liquid absorbing member 105*a*. While the first image is in contact with the liquid absorbing members 105*a* and 106*a*, the liquid absorbing members 105*a* and 106*a* remove liquid components including at least a first liquid from the first image.

Through the contact with the liquid absorbing members 105*a* and 106*a*, the liquid components included in the first image are removed. In this contacting state, the liquid absorbing members 105*a* and 106*a* are preferably pressed by the first image under a predetermined pressing force, so that the liquid absorbing members 105*a* and 106*a* effectively function.

The removal of the liquid components can be expressed from a different point view as concentrating the ink constituting the first image formed on the transfer body. Concentrating the ink means that the proportion of the solid content contained in the ink, such as a cooling material and a resin, with respect to the liquid component contained in the ink increases owing to reduction in the liquid component.

Then, movement of the transfer body 101 causes the second image from which the liquid component has been removed to move to a transfer part in which the second image contacts with the recording medium 109 to be conveyed by a recording medium conveying device 108. While the second image from which the liquid component has been removed is in contact with the recording medium 109, the pressing member 106 presses the recording medium 109, thereby forming an image (ink image) on the recording medium 109. The ink image transferred onto the recording medium 109 is a reverse image of the second image. In the following description, this transferred ink image will also be referred to as a third image in addition to the first image (ink image before liquid removal) and the second image (ink image after liquid removal).

Since the image is formed on the transfer body by applying the reaction liquid and then the ink, the reaction liquid that has not reacted with the ink remains on a non-image region (non-ink image region). In this apparatus, the liquid absorbing members 105*a* and 106*a* contact (make pressure contact) not only with the image but also with an unreacted portion of the reaction liquid, and liquid components of the reaction liquid are also removed from the surface of the transfer body 101.

Thus, the expression of removal of the liquid components from the image in the above description does not strictly mean that the liquid components are removed only from the image but means that it is sufficient to remove the liquid components at least from the image on the transfer body. For example, liquid components in the reaction liquid applied onto a region outside the image may be removed together with the liquid components in the image.

The liquid component is not specifically limited as long as the liquid component does not have a certain shape and has fluidity and a substantially constant volume.

Examples of the liquid component include water and an organic solvent included in the ink or the reaction liquid.

In a case where the clear ink is included in the first image, the ink can also be concentrated by a liquid absorbing process. For example, in a case where the clear ink is applied onto that color ink applied on the transfer body 101 which includes a coloring material, the clear ink is present over the entire surface of the first image or the clear ink is partially present at a position or a plurality of positions on the surface of the first image, and the color ink is present on the other positions of the surface of the first image. At the position of the first image where the clear ink is present over the color ink, the porous body absorbs a liquid component of the clear ink on the surface of the first image, and thus the liquid component of the clear ink moves. Accordingly, liquid components in the color ink move to the porous body so that aqueous liquid components in the color ink are absorbed. On the other hand, at a position where both a region of the clear ink and a region of the color ink are present on the surface of the first image, liquid components of the color ink and the clear ink move to the porous body so that aqueous liquid components are absorbed. The clear ink may include a large amount of components for enhancing transferability of an image from the transfer body 101 to the recording medium. For example, the clear ink may include a large amount of a component whose adhesiveness to the recording medium is higher than adhesiveness of the color ink when heated.

A conveyance unit of the ink receiving medium in the apparatus illustrated in FIGS. 1 and 2 can include a support member 102 and a driving device (not shown) for rotatably driving the support member 102.

A configuration of the transfer type ink jet recording apparatus according to this embodiment will be described below.

Transfer Body

The transfer body 101 includes a surface layer including an image forming surface. As a material for the surface layer, various materials such as resin and ceramic may be used as necessary, and a material having a high compressive elastic modulus is preferably used because of, for example, durability. Specific examples of the material include acrylic resin, acrylic silicone resin, fluorine-containing resin, and condensates obtainable by condensing a hydrolyzable organic silicon compound. To enhance wettability and transferability of the reaction liquid, the surface layer may be subjected to a surface treatment. Examples of the surface treatment include a frame treatment, a corona treatment, a plasma treatment, a polishing treatment, a roughening treatment, an activation energy ray irradiation treatment, an ozone treatment, a surfactant treatment, and a silane coupling treatment. Two or more of these treatments may be combined. The surface layer may be provided with an arbitrary surface shape.

The transfer body preferably includes a compressible layer having a function of absorbing a pressure fluctuation. In the presence of the compressible layer, the compressible layer absorbs deformation, local pressure fluctuations are dispersed so that excellent transferability can be maintained even in high-speed printing. Examples of a material for the compressible layer include acrylonitrile-butadiene rubber, acrylic rubber, chloroprene rubber, urethane rubber, and silicone rubber. In molding the rubber material, a predetermined amount of, for example, a vulcanizing agent and a vulcanization accelerator may be added, and a foaming agent and a filler such as hollow fine particles or common salt may be optionally added as necessary to form a porous product. In this manner, when various pressure fluctuations occur, air bubbles are compressed with their volumes changed. Thus, deformation in any direction except the compressed direction is small, which can provide more stable transferability and durability. Some porous rubber materials have a continuous porous structure in which pores communicate with each other, and other porous rubber materials have an independent porous structure in which pores are independently present. In the present invention, either of the structures may be employed, or both of the structures may be employed in combination.

The transfer body preferably includes an elastic layer between the surface layer and the compressible layer. As a material for the elastic layer, resin, ceramic, or other materials may be used, as necessary. In terms of processing properties, various elastomer materials and rubber materials are preferably used. Specific examples of the material include fluoro silicone rubber, phenyl silicone rubber, fluororubber, chloroprene rubber, urethane rubber, nitrile rubber, ethylene propylene rubber, natural rubber, styrene rubber, isoprene rubber, butadiene rubber, ethylene/propylene/butadiene terpolymers, and nitrile butadiene rubber. In particular, silicone rubber, fluoro silicone rubber, and phenyl silicone rubber are preferably used in terms of dimensional stability and durability because these materials have low permanent strain. These materials are also preferable in terms of transferability because a change in elastic modulus with temperature is small.

Between layers (surface layer, elastic layer, compressible layer) constituting the transfer body, various adhesives or a double face tape may be used for fixation and holding these layers. A reinforcing layer having a high compressive elastic modulus may be provided to reduce lateral extension caused when installed in an apparatus and to retain the elasticity. The reinforcing layer may be a woven fabric. The transfer body may be produced by using any combination of layers of the materials described above.

The size of the transfer body may be freely selected depending on an intended size of a printed image. The transfer body is not limited to a specific shape, and may have a sheet shape, a roller shape, a belt shape, or an endless web shape, for example.

Support Member

The transfer body 101 is supported on the support member 102. As a method for supporting the transfer body, various adhesives or a double face tape may be used. The transfer body may be supported on the support member 102 by using an installation member of, for example, metal, ceramic, or resin attached to the transfer body.

The support member 102 needs to have a structural strength to some degree from the viewpoints of conveyance accuracy and durability. The support member is preferably made of metal, ceramic, or resin, for example. In particular, to enhance responsiveness of control by reducing an inertia during operation in addition to rigidity against pressing in transfer and dimensional accuracy, aluminum, iron, stainless steel, acetal resin, epoxy resin, polyimide, polyethylene, polyethylene terephthalate, nylon, polyurethane, silica ceramic, or alumina ceramic is preferably used. Two or more of these materials are also preferably used in combination.

Reaction Liquid Applying Device

The ink jet recording apparatus according to this embodiment includes a reaction liquid applying device 103 configured to apply a reaction liquid onto the transfer body 101. The reaction liquid applying device 103 illustrated in FIGS. 1 and 2 is a gravure offset roller including a reaction liquid storage part 103*a* configured to store a reaction liquid and reaction liquid applying members 103*b* and 103*c* configured to apply the reaction liquid in the reaction liquid storage part 103*a* onto the transfer body 101.

Ink Applying Device

The ink jet recording apparatus according to this embodiment includes an ink applying device 104 configured to apply an ink onto the transfer body 101 onto which a reaction liquid is applied. The reaction liquid and the ink are mixed to form a first image, and a liquid component in the first image is absorbed in the liquid absorbing devices 105 and 106 described below.

Liquid Absorbing Device

The ink jet recording apparatus in this embodiment includes the liquid absorbing devices 105 and 106 configured to remove liquid components from an image formed of a high-viscosity ink on the transfer body with at least two or more pressure applying steps. The removal of liquid components from the image by the liquid absorbing devices 105 and 106 can promote fixation of the image. In addition, it is also possible to reduce image disturbances such as curling or cockling after transfer of an image on a recording medium (e.g. paper) caused by liquid components included in the image, set off on an overlaid sheet, and the like.

The liquid absorbing devices 105 and 106 illustrated in FIG. 1 respectively include the liquid absorbing members 105*a* and 106*a* and the pressing members 105*b* and 106*b* for liquid absorption that press the liquid absorbing members 105*a* and 106*a* against the first image on the transfer body 101. The liquid absorbing members 105*a* and 106*a* and the pressing members 105*b* and 106*b* are not limited to specific shapes. For example, the liquid absorbing devices 105 and 106 may have a configuration in which the pressing members 105*b* and 106*b* have a semicircular shape cross section and the liquid absorbing members 105*a* and 106*a* have belt shapes so that the pressing members 105*b* and 106*b* slidably press the liquid absorbing members 105*a* and 106*a* against the transfer body 101. The liquid absorbing devices 105 and 106 may also have a configuration in which the pressing members 105*b* and 106*b* have cylindrical shapes and the liquid absorbing members 105*a* and 106*a* have tubular shapes formed around the peripheries of the cylindrical pressing members 105*b* and 106*b* so that the cylindrical pressing members 105*b* and 106*b* press the tubular liquid absorbing members 105*a* and 106*a* against the transfer body.

In the present invention, in consideration of, for example, space in the ink jet recording apparatus, the liquid absorbing members 105*a* and 106*a* preferably have belt shapes.

The liquid absorbing devices 105 and 106 including the liquid absorbing members 105*a* and 106*a* having such belt shapes may include stretching members to stretch the liquid absorbing members 105*a* and 106*a*. In FIG. 1, reference characters 105*c*, 105*d*, 105*e*, 106*c*, 106*d*, and 106*e* denote stretching rollers serving as stretching members. In FIG. 1, the pressing members 105*b* and 106*b* are roller members that rotate in a manner similar to the stretching rollers, but the pressing members 105*b* and 106*b* are not limited to such a roller member.

In the liquid absorbing devices 105 and 106, the liquid absorbing members 105*a* and 106*a* including porous bodies are pressed against the first image by the pressing members 105*b* and 106*b* so that liquid components included in the first image are absorbed in the liquid absorbing members 105*a* and 106*a* to be removed from the first image.

As a method for removing the liquid components in the first image, in addition to the method of pressing the liquid absorbing member as described here, various known methods, such as a method using heating, a method of sending low-humidity air, and a method of reducing pressure, for example, may be used in combination.

The liquid absorbing members 105*b* and 105*g* in FIG. 2 have similar configurations as that of the liquid absorbing member 105*b* illustrated in FIG. 1 except that the liquid absorbing members 105*b* and 105*g* are disposed in the common liquid absorbing member 105*a*.

Requirements and configurations in the liquid absorbing devices 105 and 106 will be described in detail.

Pretreatment

In this embodiment, before the liquid absorbing members 105*a* and 106*a* including the porous bodies are brought into contact with the first image, a pretreatment is preferably performed with a pretreatment apparatus (not shown in FIGS. 1 and 2) that applies wetting liquid to the liquid absorbing member. The wetting liquid preferably includes water and a water-soluble organic solvent. Water used in this case is preferably water deionized by, for example, ion exchange. The water-soluble organic solvent is not specifically limited, and any known organic solvent such as ethanol or isopropyl alcohol may be used. In the pretreatment of the liquid absorbing member, the method of applying the wetting liquid is not limited to a specific method, and immersion or dropping of droplets is preferably employed.

Pressing Condition

The pressure of the liquid absorbing member pressed against the first image on the transfer body is preferably 2.94 $N/cm^2$ (0.3 $kgf/cm^2$) or more, because in this pressure range a liquid component in the first image can be separated from a solid component more quickly and the liquid component can be reduced from the first image. The pressure in applying the liquid absorbing member onto the image herein refers to a nip pressure between the transfer body 101 and each of the liquid absorbing members 105*a* and 106*a*, and is an average pressure calculated by performing a surface pressure measurement with a surface pressure distribution measuring device (I-SCAN, manufactured by Nitta Corporation) and dividing the weight in the pressed region by the area.

Application Time

The application time in which the liquid absorbing members 105*a* and 106*a* are in contact with the first image is preferably 50 ms (milliseconds) or less in order to further reducing adhesion of a coloring material in the first image to the liquid absorbing member. The application time herein is calculated by dividing a pressure sensing width in the direction in which the transfer body 101 moves by a travelling speed of the transfer body 101 in the surface pressure measurement described above. This application time will be hereinafter referred to as a liquid absorbing nip time.

Number of Pressing Actions

In this embodiment, a pressure applying step in which a liquid absorbing member applies pressure to an image at least twice to contact therewith is performed. In the pressure applying step, a pressure at least at a level that can be detected with a surface pressure measurement device is applied. Specifically, a pressure of 0.686 $N/cm^2$ (0.07 $kgf/cm^2$) or more is applied. In the second or subsequent pressure applying steps, a pressure applied onto the image from the liquid absorbing member is higher than a pressure in the first pressure applying step.

The first pressure applying step is performed for the purpose of absorbing a certain amount of liquid components while reducing coloring material adhesion to the liquid absorbing member and not for the purpose of completely absorbing the liquid components. By absorbing the liquid components while controlling the contact pressure so as to prevent a coloring material from adhering to the liquid absorbing member, some the liquid components can be reduced to an amount smaller than that immediately after printing. Consequently, in the second pressure applying step, even when the liquid absorbing member contacts with the image at a pressure higher than that in the first step, coloring material adhesion can be reduced, and the absorption amount can be increased as compared to a case where a plurality of liquid absorbing members simply contact with the image at the same pressure.

The absorption amount of the liquid components can be calculated from a difference obtained by measuring the weight of the liquid components after absorption in the liquid absorbing member and comparing the weight with the total weight of a discharged reaction liquid and a discharged ink.

In this embodiment, the pressure P1 applied when the liquid absorbing member contacts with the ink receiving medium in the first pressure applying step is preferably 14.71 $N/cm^2$ (1.5 $kgf/cm^2$) or less. This condition further ensures reduction of coloring material adhesion when the liquid absorbing member contacts with the ink receiving medium in the first pressure applying step.

The pressure P2 applied when the liquid absorbing member contacts with the ink receiving medium in the second pressure applying step is preferably lower than the yield stress of a dried product of an image. This dried product refers to such an image that a sample in which a reaction liquid in an amount equal to that in forming a first image per unit area and an ink in an amount equal to that in forming the first image per a unit area are mixed in the same proportion is left to stand at ordinary temperature for 24 hours. The yield stress is a value measured with a typical rheometer. This condition further enhances reduction of coloring material adhesion when the liquid absorbing member contacts with the ink receiving medium in the second pressure applying step.

In addition, the porous body of the liquid absorbing member that comes into contact with the medium in the first pressure applying step and the porous body of the liquid absorbing member that comes into contact with the medium in the second pressure applying step may be the same porous body or different porous bodies.

The liquid absorbing member that comes into contact with the medium in the first pressure applying step will be hereinafter referred to as a first liquid absorbing member, and the liquid absorbing member that comes into contact with the medium in the second pressure applying step will be hereinafter referred to as a second liquid absorbing member. In this case, regarding water pressure resistances of porous bodies defined in JISL 1092, the water pressure resistance R2 of the porous body of the second liquid absorbing member is preferably lower than the water pressure resistance R1 of the porous body of the first liquid absorbing member. In general, with decreasing water pressure resistance, the pore diameter increases. With increasing pore diameter, coloring material adhesion is more likely to occur, but in the second or subsequent contacts, this coloring material adhesion is negligible, and thus a large pore diameter can enhance durability. The pore diameter here refers to a pore diameter represented by an average diameter, and can be measured by a known method such as a nitrogen adsorption method, a mercury intrusion porosimetry method, or an SEM appearance analysis method.

The water pressure resistance R1 of the porous body of the first liquid absorbing member is preferably 250 kPa or more. With this condition, a sufficiently small diameter of the porous body of the first liquid absorbing member further ensures reduction of coloring material adhesion when the liquid absorbing member contacts with the medium in the first contact step.

The water pressure resistance R2 of the porous body of the second liquid absorbing member is preferably 100 kPa or less. With this condition, a sufficiently large pore diameter of the porous body of the second liquid absorbing member can sufficiently enhance durability of the liquid absorbing member that comes into contact with the medium in the second or subsequent step.

In this embodiment, regarding air permeability of the liquid absorbing member represented by a Gurley value measured with a Gurley tester defined in JIS P8117, the Gurley value G2 of the porous body of the second liquid absorbing member is preferably larger than the Gurley value G1 of the porous body of the first liquid absorbing member. This condition can sufficiently enhance durability of the porous body of the liquid absorbing member that comes into contact with the medium in the second or subsequent contact steps.

In this embodiment, the liquid absorbing members that contact with the medium in the first and second steps are also preferably the same liquid absorbing member as illustrated in FIG. 2. Reference character 105*g* in FIG. 2 denotes a pressing member similarly to the pressing member 105*b*, and reference character 105*f* denotes a stretching roller. Providing a plurality of liquid absorbing in the same liquid absorbing device 105 can reduce costs. The pressing members 105*b* and 105*g* include pressure control mechanisms that can control pressures to be applied, independently of each other.

Preferably, the porous body of the liquid absorbing member is water-repellent, and the contact angle between a surface of a porous body of a liquid absorbing member that comes into contact with an image and water is 90° or more. Here, the state in which the contact angle of a porous body of a liquid absorbing member with respect to water is 90° or more is defined as being water-repellent.

The contact angle refers to an angle formed by a surface of a target and a droplet which is dropped on the target at the contact part where the droplet is in contact with the target. There are several types of measurement techniques, and inventors of the present invention performed a measurement in conformity with a technique described in "6. Static Drop Method" defined in JIS R3257.

Liquid components absorbed in the liquid absorbing member can be removed by a known method. Examples of the method include a method with heating, a method of sending low-humidity air, a method of decompression, and a method of squeezing a porous body.

Transfer Pressing Member

In this embodiment, while the second image is in contact with the recording medium 109 being conveyed by the recording medium conveying device 108, the transfer pressing member 107 presses the recording medium 109 so that an image (ink image) is transferred onto the recording medium 109. The transfer onto the recording medium 109 after removal of the liquid components included in the first image on the transfer body 101 can obtain a recorded image in which curling and cockling, and the like are reduced.

The pressing member 107 needs to have a structural strength to some degree from the viewpoints of conveyance accuracy and durability of the recording medium 109. The pressing member 107 is preferably made of metal, ceramic, or resin, for example. In particular, to enhance responsiveness of control by reducing an inertia during operation in addition to rigidity against pressing in transfer and dimensional accuracy, aluminum, iron, stainless steel, acetal resin, epoxy resin, polyimide, polyethylene, polyethylene terephthalate, nylon, polyurethane, silica ceramic, or alumina ceramic is preferably used. Two or more of these materials may be used in combination.

The time during which the pressing member 107 presses the recording medium 109 in order to transfer the second image on the transfer body 101 onto the recording medium 109 is not specifically limited, and is preferably 5 ms or more to 100 ms or less in order to perform transfer appropriately and prevent impairing of durability of the transfer body. The time of pressing herein refers to a time during which the recording medium 109 is in contact with the transfer body 101, and is calculated by performing a surface pressure measurement with a surface pressure distribution measuring device (I-SCAN, manufactured by Nitta Corporation) and dividing the length in the conveyance direction of a pressed region by the conveyance speed.

The pressure with which the pressing member 107 presses the recording medium 109 in order to transfer the second image on the transfer body 101 onto the recording medium 109 is not specifically limited as long as the transfer is appropriately performed and durability of the transfer body is not impaired. To satisfy these requirements, the pressure is preferably 9.8 N/cm$^2$ (1 kgf/cm$^2$) or more to 294.2 N/cm$^2$ (30 kgf/cm$^2$) or less. The pressure in this embodiment refers to a nip pressure between the recording medium 109 and the transfer body 101, and is calculated by performing a surface pressure measurement with a surface pressure distribution measuring device and dividing the weight in a pressed region by the area.

The temperature at which the pressing member 107 presses the recording medium 109 in order to transfer the second image on the transfer body 101 onto the recording medium 109 is not specifically limited, and is preferably greater than or equal to the glass transition point or the softening point of a resin component included in the ink. Heating is preferably performed with a heating device configured to heat the second image on the transfer body 101 and the recording medium 109.

The pressing member 107 is not limited to a specific shape, and may be a roller shape, for example.

Recording Medium and Recording Medium Conveying Device

In this embodiment, the recording medium 109 is not specifically limited, and any known recording medium may be used. Examples of the recording medium include a rolled long medium and a cut-sheet medium cut into a predetermined size. Examples of a material for the recording medium include paper, a plastic film, a wooden board, a corrugated cardboard, and a metal film.

In FIGS. 1 and 2, the recording medium conveying device 108 for conveying the recording medium 109 includes a recording medium feeding roller 108*a* and a recording medium winding roller 108*b*. The recording medium conveying device 108 only needs to convey the recording medium, and is not limited to this configuration.

Control System

Figure 4:
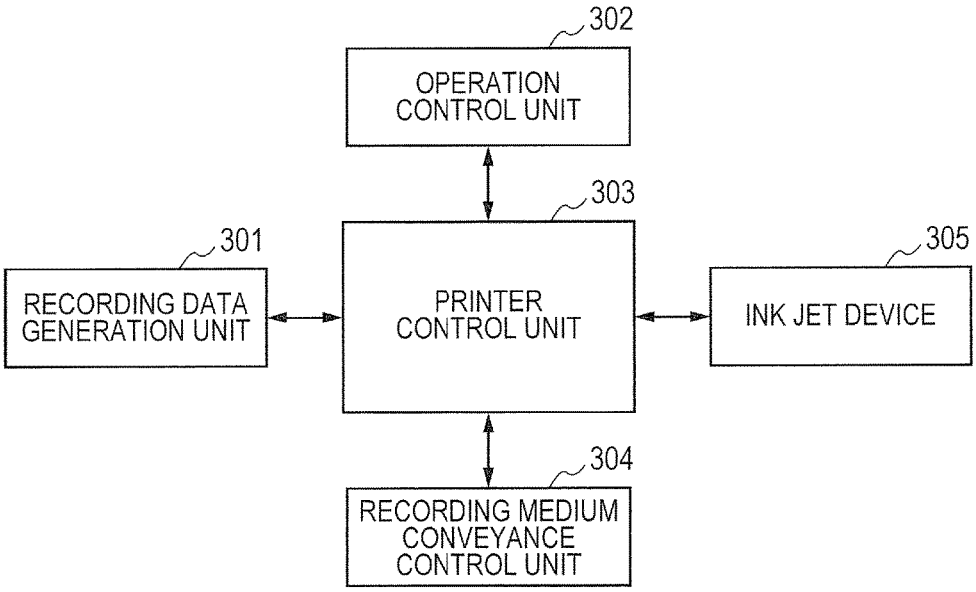
FIG. 4 is a block diagram illustrating a control system of the entire ink jet recording apparatus illustrated in FIGS. 1 and 2.

The transfer type ink jet recording apparatus according to this embodiment includes a control system that controls devices. FIG. 4 is a block diagram illustrating a control system of the entire transfer type ink jet recording apparatus illustrated in FIGS. 1 and 2.

In FIG. 4, reference numeral 301 denotes a recording data generating unit such as an external print server, reference numeral 302 denotes an operation control unit such as an operation panel, reference numeral 303 denotes a printer control unit to perform a recording process, reference numeral 304 denotes a recording medium conveyance control unit to convey a recording medium, and reference numeral 305 denotes an ink jet device to perform printing.

Figure 5:
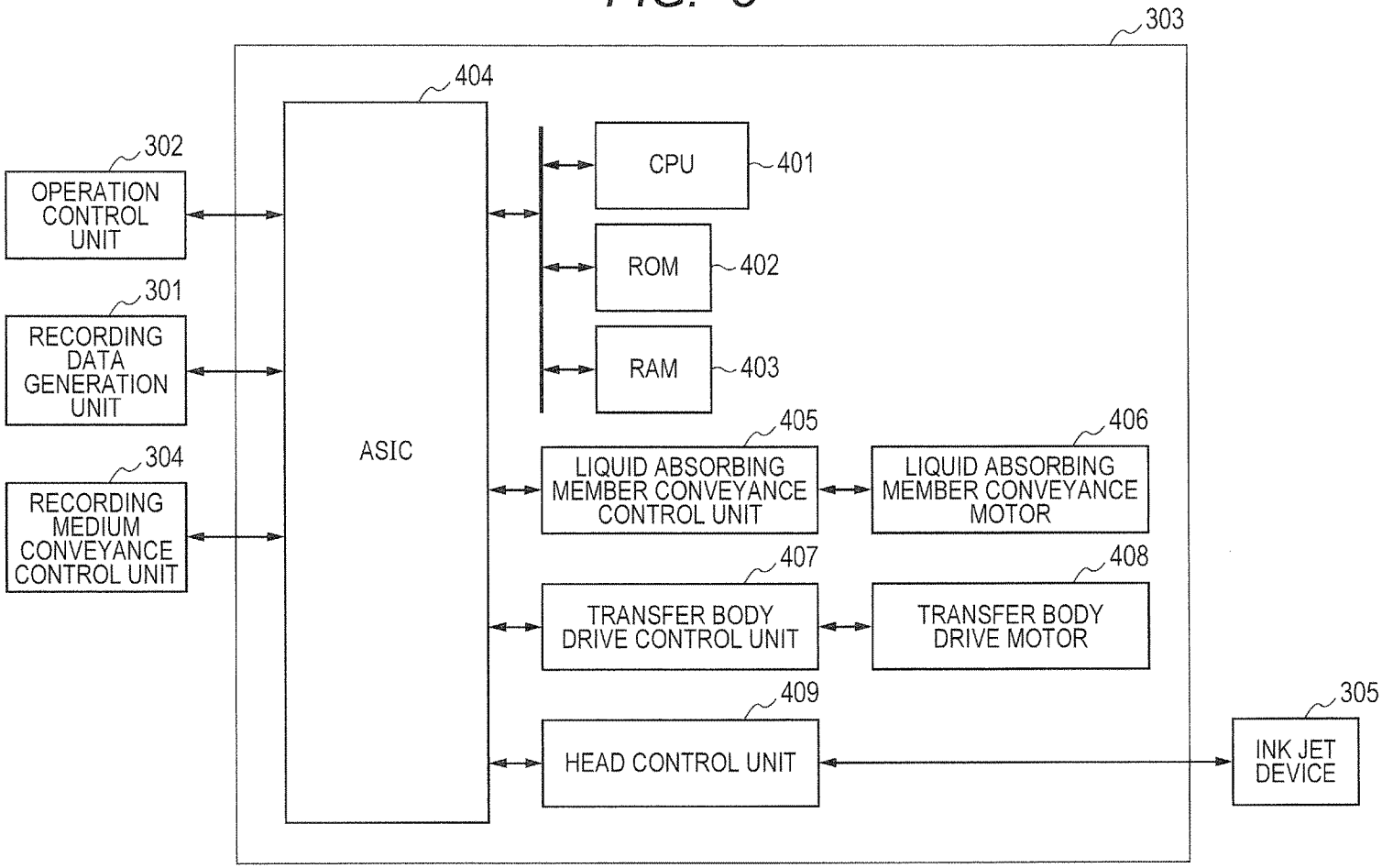
FIG. 5 is a block diagram of a printer control unit in the transfer type ink jet recording apparatus illustrated in FIGS. 1 and 2.

FIG. 5 is a block diagram of a printer control unit in the transfer type ink jet recording apparatus illustrated in FIGS. 1 and 2.

Reference numeral 401 denotes a CPU to control the entire printer, reference numeral 402 denotes a ROM to store a control program of the CPU, and reference numeral 403 denotes a RAM to execute a program. Reference numeral 404 denotes an application specific integrated circuit (ASIC) incorporating a network controller, a serial IF controller, a head data generating controller, and a motor controller, for example. Reference numeral 405 denotes a liquid absorbing member conveyance control unit to drive a liquid absorbing member conveyance motor 406, and is subjected to command control by the ASIC 404 through a serial IF. Reference numeral 407 denotes a transfer body drive control unit to drive a transfer body drive motor 408, and is subjected to command control by the ASIC 404 through the serial IF similarly. Reference numeral 409 denotes a head control unit to generate final discharge data of the ink jet device 305 and to generate a driving voltage, for example.

Direct Drawing Type Ink Jet Recording Apparatus

As another embodiment of the present invention, a direct drawing type ink jet recording apparatus will be described. In the direct drawing type ink jet recording apparatus, an ink receiving medium is a recording medium on which an image is to be formed thereon.

Figure 3:
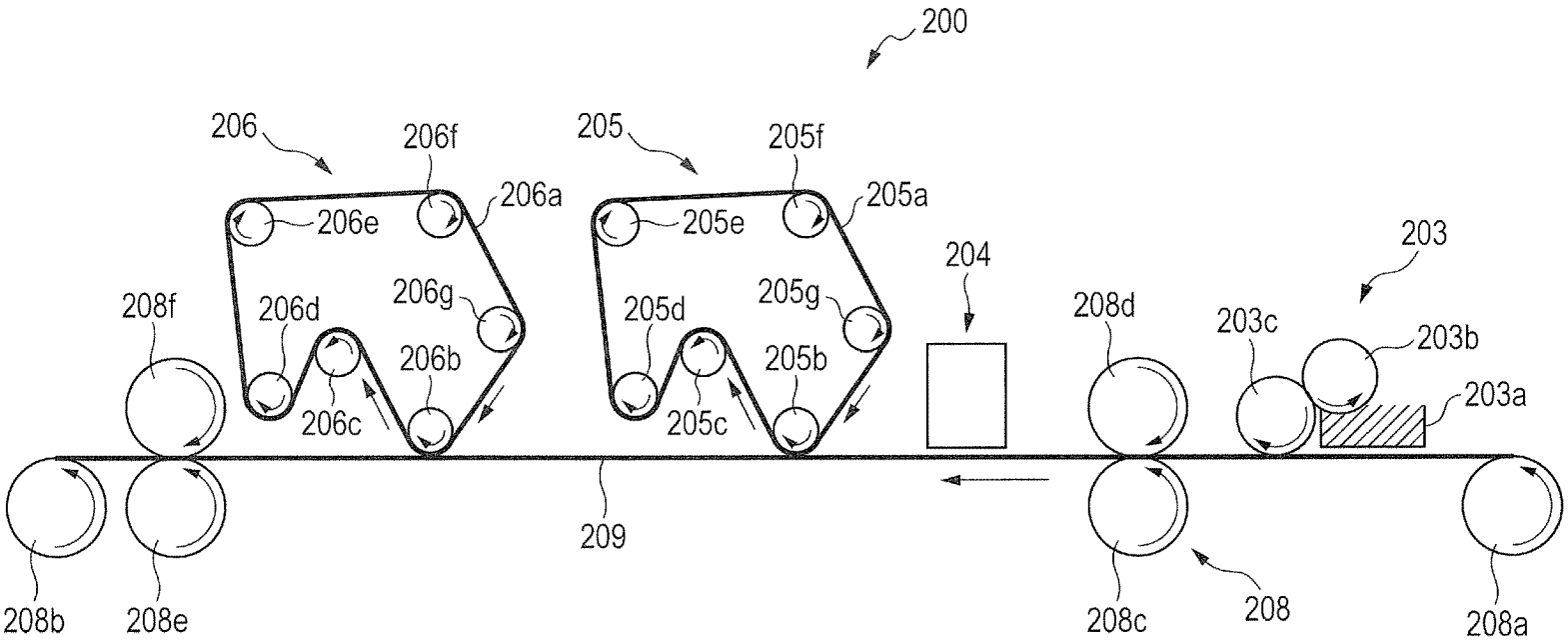
FIG. 3 schematically illustrates an example configuration of a direct drawing type ink jet recording apparatus according to the present invention.

FIG. 3 schematically illustrates an example configuration of a direct drawing type ink jet recording apparatus 200 according to this embodiment. As compared to the transfer type ink jet recording apparatus described above, the direct drawing type ink jet recording apparatus includes a configuration similar to those of the transfer type ink jet recording apparatus except that direct drawing type ink jet recording apparatus does not include any of the transfer body 101, the support member 102, and the transfer body cleaning member 109 and forms an image on a recording medium 209.

Thus, a reaction liquid applying device 203 configured to apply a reaction liquid onto the recording medium 209, an ink applying device 204 configured to apply an ink onto the recording medium 209, and a liquid absorbing device 205 configured to absorb liquid components included in a first image by using liquid absorbing devices 205 and 206 that absorbs liquid components included in a first image by using liquid absorbing members 205*a* and 206*a* that come into contact with the first image on the recording medium 209 each have a configuration similar to that of the transfer type ink jet recording apparatus, and thus description thereof will not be repeated.

In the direct drawing type ink jet recording apparatus according to this embodiment, the liquid absorbing devices 205 and 206 include the liquid absorbing members 205*a* and 206*a* and pressing members 205*b* and 206*b* for liquid absorption that press the liquid absorbing members 205*a* and 206*a* against the first image on the recording medium 209. The liquid absorbing members 205*a* and 206*a* and the pressing members 205*b* and 206*b* are not limited to specific shapes, and may have similar shapes to those of a liquid absorbing member and a pressing member that can be used in the transfer type ink jet recording apparatus. The liquid absorbing devices 205 and 206 may include a stretching member to stretch the liquid absorbing member. In FIG. 3, reference characters 205*c*, 205*d*, 205*e*, 205*f*, 205*g*, 206*c*, 206*d*, 206*e*, 206*f*, and 206*g* denote extending rollers serving as stretching members. The number of stretching rollers is not limited to five in FIG. 3, and may be any necessary number depending on apparatus design. There may be provided an ink applying unit configured to apply an ink onto the recording medium 209 by the ink applying device 204, and may be provided an unillustrated recording medium support member configured to support the bottom of the recording medium at a location opposite to a liquid component removing unit configured to cause the liquid absorbing members 205*a* and 206*a* to make pressure contact with the first image on the recording medium to remove liquid components.

Recording Medium Conveying Device

In a direct drawing type ink jet recording apparatus according to this embodiment, a recording medium conveying device 208 constitutes a conveyance unit of a recording medium which is an ink receiving medium. The configuration of the recording medium conveying device 208 is not limited to a specific configuration, and a known conveyance unit in a direct drawing type ink jet recording apparatus can be used. For example, as illustrated in FIG. 3, a recording medium conveying device including a recording medium feeding roller 208*a*, a recording medium winding roller 208*b*, and recording medium conveying rollers 208*c*, 208*d*, 208*e*, and 208*f* may be used.

Control System

Figure 6:
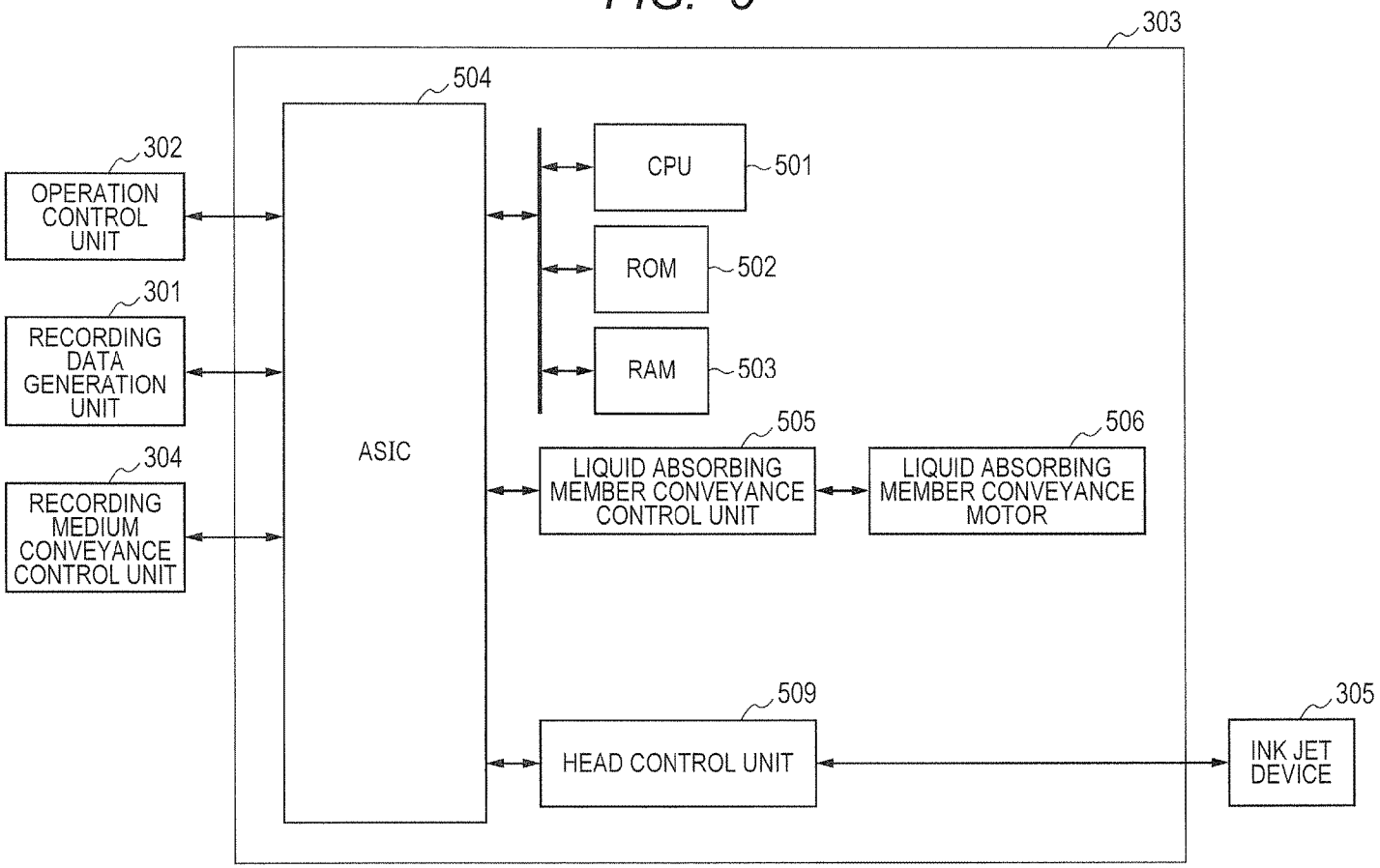
FIG. 6 is a block diagram illustrating a printer control unit in the direct drawing type ink jet recording apparatus illustrated in FIG. 3.

The direct drawing type ink jet recording apparatus according to this embodiment includes a control system to control devices. FIG. 6 illustrates a block diagram of the control system of the entire direct drawing type ink jet recording apparatus illustrated in FIG. 3, similar to the transfer type ink jet recording apparatus illustrated in FIG. 1.

FIG. 6 is a block diagram illustrating a printer control unit in the direct drawing type ink jet recording apparatus illustrated in FIG. 3. The block diagram illustrated in FIG. 5 is similar to the block diagram of the printer control unit in the transfer type ink jet recording apparatus illustrated in FIG. 5, except that the printer control unit does not include any of the transfer body drive control unit 407 and the transfer body drive motor 408.

In FIG. 6, reference numeral 501 denotes a CPU to control the entire printer, reference numeral 502 denotes a ROM to store a control program of a CPU, and reference numeral 503 denotes a RAM to execute a program. Reference numeral 504 denotes an ASIC incorporating a network controller, a serial IF controller, a head data generating controller, and a motor controller, for example. Reference numeral 505 denotes a liquid absorbing member conveyance control unit to drive a liquid absorbing member conveyance motor 506, and is subjected to command control by the ASIC 504 through a serial IF. Reference numeral 509 denotes a head control unit to generate final discharge data of the ink jet device 305 and generate a driving voltage, for example.

EXAMPLES

The present invention will now be more specifically described with reference to examples and comparative examples. The present invention is not limited to the following examples, unless exceeding the gist thereof. In the following description of the examples, "part(s)" is based on weight unless otherwise specified.

Example 1

In this example, the transfer type ink jet recording apparatus illustrated in FIG. 1 was used.

The transfer body 101 of this example is fixed to a support member 102 with an adhesive.

In this example, a sheet in which a PET sheet with a thickness of 0.5 mm was coated with silicone rubber (trade name: KE12, manufactured by Shin-Etsu Chemical Co., Ltd.) having a thickness of 0.3 mm was used as an elastic layer of the transfer body. In addition, a mixture of a condensate obtained by mixing glycidoxypropyl triethoxysilane and methyltriethoxysilane at a mole ratio of 1:1 and subjected to heat refluxing and a cationic photopolymerization initiator (trade name: SP150, manufactured by ADEKA Corporation) was prepared.

An atmospheric pressure plasma treatment was performed in such a manner that the contact angle of water on the surface of the elastic layer was 10 degrees or less. Thereafter, the mixture was applied onto the elastic layer to form a film with UV irradiation (with a high-pressure mercury lamp having a cumulative exposure of 5000 mJ/cm$^2$) and heat curing (at 150° C. for 2 hours), thereby producing the transfer body 101 in which a surface layer with a thickness of 0.5 μm was formed on the elastic layer.

In this configuration, although not shown for simplicity of description, a double face tape was used to hold the transfer body 101 between the transfer body 101 and the support member 102.

In this configuration, the surface of the transfer body 101 was kept at 60° C. by an unillustrated heater.

The reaction liquid applied by the reaction liquid applying device 103 had the composition below. The amount of application of the reaction liquid was 1 g/m$^2$.

glutaric acid 21.0 parts glycerin 5.0 parts surfactant (trade name: Megafac F444, manufactured by DIC Corporation) 5.0 parts ion-exchanged water balance The ink was prepared in the following manner.

Preparation of Pigment Dispersion

First, 10 parts of carbon black (trade name: MONARCH 1100, manufactured by Cabot Corporation), 15 parts of a resin aqueous solution (a solution of a styrene-ethyl acrylate-acrylic acid terpolymer having an acid value of 150, a weight-average molecular weight (Mw) of 8,000, and a resin content of 20.0 mass % neutralized with a potassium hydroxide aqueous solution), and 75 parts of pure water were mixed. This mixture was fed in a batch type vertical sand mill (manufactured by AIMEX Co., Ltd.), and the mill was charged with 200 parts of zirconia beads having a diameter of 0.3 mm. These material were dispersed for five hours while being cooled with water. Then, this dispersion liquid was centrifugalized so that coarse particles were removed, and then, a black pigment dispersion having a pigment content of 10.0 mass % was obtained.

Preparation of Resin Particle Dispersion

First, 20 parts of ethyl methacrylate, 3 parts of 2,2'-azobis-(2-methylbutyronitrile), and 2 parts of n-hexadecane were mixed, and the mixture was stirred for 0.5 hours. This mixture was dropped to 75 parts of an 8 mass % aqueous solution of a styrene-butyl acrylate-acrylic acid copolymer (having an acid value of 130 mgKOH/g, a weight-average molecular weight (Mw) of 7,000), followed by stirring for 0.5 hours. Then, the resulting mixture was subjected to supersonic wave irradiation for 3 hours with a supersonic wave irradiator. Subsequently, the mixture was subjected to a polymerization reaction for 4 hours in a nitrogen atmosphere at 80° C., followed by cooling to room temperature. The reaction product was then filtered to yield a resin particle dispersion with a resin content of 25.0 mass %.

Preparation of Ink

The resin particle dispersion obtained above and the pigment dispersion were mixed with the components below. The indication "balance" for ion-exchanged water refers to an amount with which the sum of all the components constituting the ink is 100.0 mass %.

pigment dispersion (with a coloring material content of 10.0 mass %) 40.0 mass % resin fine particle dispersion 20.0 mass % glycerin 7.0 mass % polyethylene glycol (having a number-average molecular weight (Mn) of 1,000) 3.0 mass % surfactant:Acetylenol E100 (trade name, manufactured by Kawaken Fine Chemicals Co., Ltd.) 0.5 mass % ion-exchanged water balance

These materials were sufficiently stirred to be dispersed, and then subjected to pressure filtration through a microfilter having a pore size of 3.0 μm (manufactured by Fujifilm Corporation), thereby preparing a black ink.

After 1 g of the reaction liquid and 25 g of the ink was mixed, the mixture was dried at ordinary temperature for 24 hours and measured with a rheometer, to find that the yield stress was 0.44 MPa (4.5 kgf/cm$^2$).

The ink applying device 104 used an ink jet head of such a type as to discharge an ink in an on-demand manner with an electrothermal converter. The amount of the ink applied in image formation was 10 g/m$^2$.

The conveyance speed of the liquid absorbing member 105*a* was adjusted to a speed substantially equal to a travelling speed of the transfer body 101 by the conveying rollers 105*c*, 105*d*, and 105*e* stretching the liquid absorbing member 105*a* and conveying the liquid absorbing member 105*a*. To adjust the conveyance speed substantially equal to the travelling speed of the transfer body 101, the recording medium 109 was conveyed by the recording medium feeding roller 108*a* and the recording medium winding roller 108*b*. The conveyance speed in this example was 0.2 m/s. As the recording medium 109, Aurora Coat (manufactured by Nippon Paper Industries Co., Ltd. with a basis weight of 104 g/m$^2$) was used.

In this example, the liquid absorbing member was immersed in a wetting liquid including 95 parts of ethanol and 5 parts of water, which thud permeated therethrough and then was replaced with a liquid of 100 parts of water, and the resulting member was used for liquid removal.

Each of the pressing members 105*b* and 106*b* in this example had a roller radius of φ200 mm.

In this example, as the liquid absorbing members 105*a* and 106*a*, the same porous body of hydrophilic polytetrafluoroethylene (PTFE) was used. This porous body had an average pore diameter of 0.2 μm and a Gurley value of 5 seconds.

Examples 2 to 9

In Examples 2 to 9, evaluation was conducted by using the apparatus illustrated in FIG. 1 in a manner similar to that in Example 1 except that different porous bodies and different pressure conditions were used.

Example 10

Figure 7:
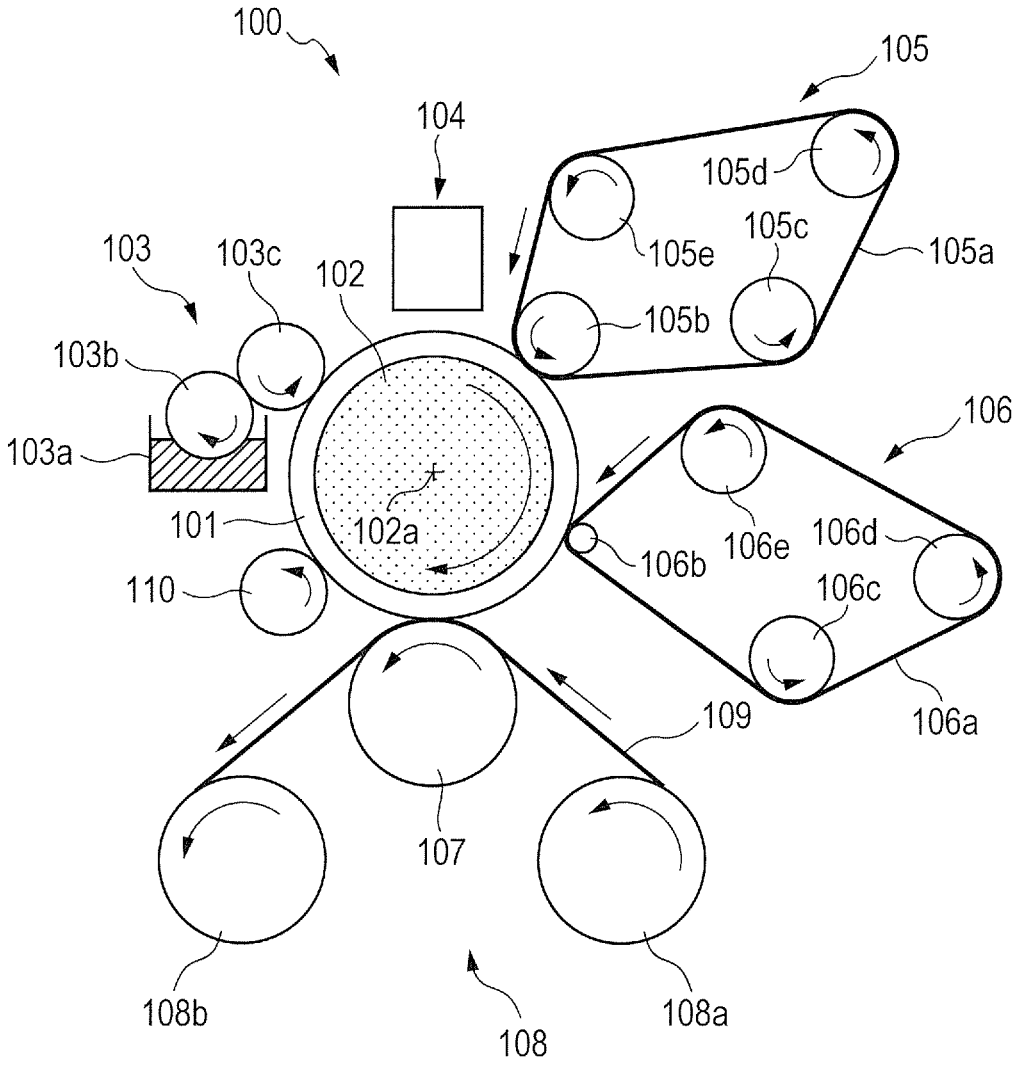
FIG. 7 schematically illustrates an example configuration of a transfer type ink jet recording apparatus according to the present invention.

In Example 10, in the apparatus illustrated in FIG. 7, the member 106*b* having a roller radius of φ20 mm was used under the same conditions as in Example 1.

Comparative Examples 1 and 2

In Comparative Examples 1 and 2, evaluations were conducted by using the apparatus illustrated in FIG. 1 in a manner similar to that in Example 1 except that different porous bodies and different pressure conditions were used.

Porous bodies used in the evaluations are shown in Table 2 below. In each example, emulsion polymerization particles of crystallized PTFE were compression molded and stretched at a temperature of the melting point or less, thereby obtaining a fibrillated porous body.

In this example, as the liquid absorbing members 105*a* and 106*a*, the same porous body of hydrophilic polytetrafluoroethylene (PTFE) was used. This porous body had an average pore diameter of 0.2 μm and a Gurley value of 5 seconds.

Table 3 below shows combinations of roller radius and pressure conditions of the pressing members 105*b* and 106*b* in the liquid absorbing devices 105 and 106 and the liquid absorbing members 105*a* and 106*a*.

TABLE 2

| Absorbent type | Average pore diameter (μm) | Gurley value (sec.) |
|---|---|---|
| A | 0.5 | 5 |
| B | 0.4 | 5 |
| C | 0.3 | 5 |
| D | 0.7 | 5 |
| E | 1.0 | 5 |
| F | 0.5 | 10 |

TABLE 3

| | First stage | | | Second stage | | |
|---|---|---|---|---|---|---|
| | Roller radius mm | Pressure (kg/cm$^2$) | Liquid absorbing member Type 105a | Roller radius mm | Pressure (kg/cm$^2$) | Liquid absorbing member Type 106a |
| Example 1 | 200 | 2 | A | 200 | 5 | A |
| Example 2 | 200 | 2 | A | 200 | 5 | D |
| Example 3 | 200 | 1 | A | 200 | 5 | A |
| Example 4 | 200 | 1.5 | A | 200 | 5 | A |
| Example 5 | 200 | 2 | A | 200 | 4 | A |
| Example 6 | 200 | 2 | B | 200 | 5 | A |
| Example 7 | 200 | 2 | C | 200 | 5 | A |
| Example 8 | 200 | 2 | A | 200 | 5 | E |
| Example 9 | 200 | 2 | A | 200 | 5 | F |
| Example 10 | 200 | 2 | A | 20 | 5 | A |
| Comparative Example 1 | 200 | 2 | A | 200 | 2 | A |
| Comparative Example 2 | 200 | 5 | A | 200 | 5 | D |

Evaluation

Under the conditions, evaluation was conducted by the following evaluation method. Table 4 shows evaluation results. In the present invention, evaluation criteria AA and B are defined as preferable levels and criterion C is defined as an unacceptable level in evaluation items below.

Coloring Material Adhesion

The amount of coloring material adhesion after contact on the absorbing member under the conditions described above is shown. The coloring material adhesion is preferably small. Evaluation criteria are as follows:

A: Coloring material adhesion was not observed.

B: Coloring material adhesion was slightly observed but at a negligible level.

C: Significant coloring material adhesion was observed.

Absorption Amount

The degree of coloring material adhesion on a back surface of a recording medium overlying another recording medium after transferring was evaluated.

A: Coloring material adhesion was not observed.

B: Slight coloring material adhesion occurred but at a negligible level.

C: Significant coloring material adhesion was observed.

Durability of Liquid Absorbing Member

In the case of repeatedly using the porous body obtained as described above as a belt-shaped liquid absorbing member 105*b*, a difference in absorption amount from the amount at the first time was evaluated. A smaller difference means a high durability. Evaluation criteria are as follows:

AA: No difference in absorption amount was observed between the first time and after repetition of 10000 times.

A: No difference in absorption amount was observed between the first time and after repetition of 1000 times. A slight difference in absorption amount was observed between the first time and after repetition of 10000 times, but at a negligible level.

B: A slight difference in absorption amount was observed between the first time and after repetition of 1000 times, but at a negligible level.

C: A difference in absorption amount was observed between the first time and after repetition of 1000 times.

TABLE 4

| No. | Coloring material adhesion first stage | Coloring material adhesion second stage | Absorption amount | Durability |
|---|---|---|---|---|
| Example 1 | B | B | B | B |
| Example 2 | B | B | B | A |
| Example 3 | A | B | B | B |
| Example 4 | A | B | B | B |
| Example 5 | B | A | B | B |
| Example 6 | B | B | B | B |
| Example 7 | A | B | B | B |
| Example 8 | B | B | B | AA |
| Example 9 | B | B | B | A |
| Example 10 | B | B | A | B |
| Comparative Example 1 | B | B | C | A |
| Comparative Example 2 | B | B | A | C |

A similar experiment was carried out using not a transfer type but the direct drawing type ink jet recording apparatus that is illustrated in FIG. 3 and applies a reaction liquid directly onto a recording medium to apply ink. In image evaluation in the direct drawing type ink jet recording apparatus illustrated in FIG. 3, GLORIA PURE WHITE with a basis weight of 210 g/m2 (manufactured by Gojo Paper Mfg. co., ltd.) was used as the recording medium.

The reaction liquid composition, the reaction liquid applying device 203, the ink composition, the ink applying device 204, the conveyance speed of the recording medium and the liquid absorbing devices 205 and 206, except the recording medium, were similar to those of the transfer type ink jet recording apparatus used in Example 1, and an evaluation similar to that of Example 1 was carried out.

As a result, it was confirmed that the same results as those in Table 4 were observed.

As described above, in the present invention, the liquid absorbing step in which liquid is absorbed from an image containing liquid components using the liquid absorbing member includes the multi-stage pressing process including the pressing step (P-1) of pressing the porous body of the liquid absorbing member against the image under a pressure P1 and the pressing step (P-2) of pressing the porous body of the liquid absorbing member against the image under a pressure P2. The pressing step is conducted preferably under conditions where pressure P1<pressure P2 and the pressing step (P-1) is performed before the pressing step (P-2).

The introduction of this multi-stage pressing process to the liquid absorbing step enables an effective amount of liquid components to be absorbed in a porous body while reducing coloring material adhesion from an image to the porous body by reducing a pressure in the pressing step (P-1) as compared to a pressure in a simple pressing step. In addition, in the pressing step (P-2), fixation of the image due to the pressing step (P-1) further proceeds and pressing with a relatively increased pressure is conducted in a state where coloring material adhesion is less likely to occur, thereby enabling liquid components remaining on the image to be effectively absorbed in the porous body. As described above, the present invention provides an ink jet recording apparatus and an ink jet recording method that enable image formation with high image quality by obtaining a large absorption amount with reduced adhesion of a coloring material with respect to the porous body in removing liquid components in an image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-016674, filed Jan. 29, 2016, and Japanese Patent Application No. 2016-107969, filed May 30, 2016, which are hereby incorporated by reference herein in their entirety.

What is claimed is:

1. An ink jet recording apparatus comprising:

an image forming unit configured to form a first image containing a first liquid and a coloring material on an ink receiving medium;

a liquid absorbing member including a porous body that comes into contact with the first image, the porous body being configured to absorb at least a part of the first liquid from the first image; and a plurality of pressure applying units configured to press the first image on the ink receiving medium by the porous body of the liquid absorbing member, wherein the plurality of pressure applying units include a first pressure applying unit configured to press the first image to absorb at least a part of the first liquid from the first image and a second pressure applying unit configured to press the first image, from which the at least a part of the first liquid has been absorbed, and an average pore diameter of a portion of the porous body pressed by the second pressure applying unit is greater than an average pore diameter of a portion of the porous body pressed by the first pressure applying unit.

2. The ink jet recording apparatus according to claim 1, wherein the plurality of pressure applying units are provided for a common liquid absorbing member.

3. The ink jet recording apparatus according to claim 1, wherein the plurality of pressure applying units include one or more combinations of pressure applying units configured to apply pressures to different liquid absorbing members.

4. The ink jet recording apparatus according to claim 1, wherein the portion of the porous body pressed by the first pressure applying unit has an average pore diameter of 0.3 μm or less.

5. The ink jet recording apparatus according to claim 1, wherein the portion of the porous body pressed by the second pressure applying unit has an average pore diameter of 1 μm or more.

6. The ink jet recording apparatus according to claim 1, wherein a Gurley value G2 of the portion of the porous body pressed by the second pressure applying unit is smaller than a Gurley value G1 of the portion of the porous body pressed by the first pressure applying unit.

7. The ink jet recording apparatus according to claim 1, wherein the first pressure applying unit is configured to press the first image at a pressure of 1.5 $kg/cm^2$ or less.

8. The ink jet recording apparatus according to claim 1, wherein the second pressure applying unit is configured to press the first image at a pressure lower than a yield stress of a dried product of the first image.

9. The ink jet recording apparatus according to claim 1, wherein the image forming unit includes:

a first applying device configured to apply a first liquid composition including the first liquid or a second liquid onto the ink receiving medium; and a second applying device configured to apply a second liquid composition including either the first liquid or the second liquid and the coloring material onto the ink receiving medium, wherein at least one of the first liquid composition and the second liquid composition includes the first liquid, and wherein the first image includes a mixture of the first liquid composition and the second liquid composition and is thickened to be more viscous than each of the first liquid composition and the second liquid composition.

10. The ink jet recording apparatus according to claim 9, wherein the second liquid composition is an aqueous pigment ink including water as the first liquid and including at least a pigment as the coloring material, and wherein the first liquid composition is a reaction liquid configured to reduce a dispersion stability of the pigment in the aqueous pigment ink.

11. The ink jet recording apparatus according to claim 10, wherein the aqueous pigment ink is applied onto the ink receiving medium by an ink jet method.

12. The ink jet recording apparatus according to claim 1, wherein the ink receiving medium is a transfer body to temporarily hold the first image and a second image obtained by absorbing the first liquid from the first image and transfer the second image onto a recording medium.

13. The ink jet recording apparatus according to claim 1, wherein the ink receiving medium is a recording medium for forming a final image, and wherein the liquid absorbing member forms a second image obtained by absorbing at least a part of the first liquid from the first image on the recording medium.

14. The ink jet recording apparatus according to claim 1, wherein the first pressure applying unit is configured to press the first image at a first pressure to absorb at least the part of the first liquid from the first image and the second pressure applying unit is configured to press the first image, from which the at least a part of the first liquid has been absorbed, at a second pressure higher than the first pressure.

15. An ink jet recording apparatus comprising:

an image forming unit configured to form an ink image containing an aqueous liquid component and a coloring material on an ink receiving medium;

a liquid absorbing member including a porous body that comes into contact with the ink image, the porous body being configured to absorb at least a part of the aqueous liquid component from the ink image to concentrate an ink constituting the ink image; and a plurality of pressure applying units configured to press the ink image on the ink receiving medium by the porous body of the liquid absorbing member, wherein the plurality of pressure applying units include a first pressure applying unit configured to press the ink image to absorb at least a part of the aqueous liquid from the ink image and a second pressure applying unit configured to press the ink image, from which the at least a part of the aqueous liquid has been absorbed, and an average pore diameter of a portion of the porous body pressed by the second pressure applying unit is greater than an average pore diameter of a portion of the porous body pressed by the first pressure applying unit.

16. The ink jet recording apparatus according to claim 15, wherein the first pressure applying unit is configured to press the ink image at a first pressure to absorb at least the part of the aqueous liquid from the first image and the second pressure applying unit is configured to press the ink image, from which the at least a part of the aqueous liquid has been absorbed, at a second pressure higher than the first pressure.

17. An ink jet recording apparatus comprising:

an image forming unit configured to form a first image containing a first liquid and a coloring material on an ink receiving medium;

a liquid absorbing member including a porous body that comes into contact with the first image, the porous body being configured to absorb at least a part of the first liquid from the first image; and a plurality of pressure applying units configured to press the first image on the ink receiving medium by the porous body of the liquid absorbing member, wherein the plurality of pressure applying units include a first pressure applying unit including a first roller to press the first image to absorb at least a part of the first liquid from the first image and a second pressure applying unit including a second roller to press the first image, from which the at least a part of the first liquid has been absorbed, and a roller radius of the first roller is greater than a roller radius of the second roller.

18. The ink jet recording apparatus according to claim 17, wherein the first pressure applying unit is configured to press the first image at a first pressure to absorb the at least a part of the first liquid from the first image and the second pressure applying unit is configured to press the first image, from which the at least a part of the first liquid has been absorbed, at a second pressure higher than the first pressure.

19. An ink jet recording apparatus comprising:

an image forming unit configured to form an ink image containing an aqueous liquid component and a coloring material on an ink receiving medium;

a liquid absorbing member including a porous body that comes into contact with the ink image, the porous body being configured to absorb at least a part of the aqueous liquid component from the ink image to concentrate an ink constituting the ink image; and a plurality of pressure applying units configured to press the ink image on the ink receiving medium by the porous body of the liquid absorbing member, wherein the plurality of pressure applying units include a first pressure applying unit including a first roller to press the ink image to absorb at least a part of the aqueous liquid from the ink image and a second pressure applying unit including a second roller to press the ink image, from which the at least a part of the aqueous liquid has been absorbed, and a roller radius of the first roller is greater than a roller radius of the second roller.

20. The ink jet recording apparatus according to claim 19, wherein the first pressure applying unit is configured to press the ink image at a first pressure to absorb the at least a part of the aqueous liquid from the ink image and the second pressure applying unit is configured to press the ink image, from which the at least a part of the aqueous liquid has been absorbed, at a second pressure higher than the first pressure.

* * * * *